US010046569B2

(12) United States Patent
Koizumi et al.

(10) Patent No.: US 10,046,569 B2
(45) Date of Patent: Aug. 14, 2018

(54) CARTRIDGE, CARTRIDGE UNIT AND LIQUID EJECTION SYSTEM

(71) Applicant: SEIKO EPSON CORPORATION, Tokyo (JP)

(72) Inventors: Yoshihiro Koizumi, Shiojiri (JP); Hiroyuki Nakamura, Shiojiri (JP); Ayumi Yoshida, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/478,598

(22) Filed: Apr. 4, 2017

(65) Prior Publication Data

US 2017/0203577 A1 Jul. 20, 2017

Related U.S. Application Data

(63) Continuation of application No. 15/065,086, filed on Mar. 9, 2016, now Pat. No. 9,634,228.

(30) Foreign Application Priority Data

Mar. 30, 2015 (JP) ..... 2015-067853

(51) Int. Cl.
*B41J 2/175* (2006.01)

(52) U.S. Cl.
CPC ..... *B41J 2/17553* (2013.01); *B41J 2/17513* (2013.01)

(58) Field of Classification Search
CPC .. B41J 2/17513; B41J 2/17523; B41J 2/1752; B41J 2/1753; B41J 2/17553; B41J 29/13
USPC ..... 347/86
See application file for complete search history.

(56) References Cited

U.S. PATENT DOCUMENTS

| | | | | |
|---|---|---|---|---|
| 6,074,042 | A | 6/2000 | Gasvoda et al. | |
| 2004/0027432 | A1* | 2/2004 | Childers | B41J 2/17509 347/86 |
| 2005/0185036 | A1 | 8/2005 | Seino et al. | |
| 2008/0284810 | A1 | 11/2008 | Shimizu et al. | |
| 2010/0079517 | A1* | 4/2010 | Akatsuka | B41J 2/17566 347/7 |
| 2014/0063147 | A1* | 3/2014 | Iwamuro | B41J 2/17543 347/86 |

FOREIGN PATENT DOCUMENTS

| | | |
|---|---|---|
| JP | 2002-512340 A | 5/2002 |
| JP | 2011-235652 A | 11/2011 |

* cited by examiner

*Primary Examiner* — Huan Tran
*Assistant Examiner* — Alexander D Shenderov
(74) *Attorney, Agent, or Firm* — Foley & Lardner LLP

(57) ABSTRACT

A cartridge comprises a liquid container that is at least partly made of a flexible material and is configured to contain a liquid therein; a recess that is configured to be open toward a mounting direction of the cartridge to a liquid ejection apparatus; and a fluid receiving portion that is placed inside of the recess and is configured to receive supply of a pressurized fluid.

11 Claims, 13 Drawing Sheets

4K

CARTRIDGE, CARTRIDGE UNIT AND LIQUID EJECTION SYSTEM

CROSS-REFERENCE TO RELATED APPLICATIONS

This application claims priority to Japanese Patent Application No. (JP) 2015-067853 filed on Mar. 30, 2015 entire disclosure of which is incorporated herein by reference for all purposes.

BACKGROUND

Field

The present invention relates to a technique with regard to a cartridge.

Related Art

A cartridge that is mountable to a holder (cartridge mounting assembly) of a liquid ejection apparatus has been proposed (for example, JP 2011-235652A). This cartridge includes an ink pack which is configured to internally contain ink, and an air inlet port (fluid receiving portion) which is connected with an air communication port of a printer and which the pressurized air flows in. The ink pack is pressurized by the pressurized air that is fed through the air communication port and the air inlet port into the cartridge. This causes ink contained in the ink pack to be supplied to the printer.

In the above proposed configuration, the fluid receiving portion is placed in an area where two directions of the cartridge are open. This configuration is, however, likely to cause various problems described below with regard to the fluid receiving portion. For example, an external force is likely to be applied to the fluid receiving portion by the user's touch or the like and deform the fluid receiving portion. In another example, a foreign substance is likely to adhere to the fluid receiving portion and damage the functions of the fluid receiving portion. In another example, ink leaking during mounting or demounting of the cartridge to or from the cartridge mounting assembly is likely to adhere to the air inlet port or its periphery.

Accordingly there is a need to provide a technique that reduces the occurrence of such possible problems with regard to the fluid receiving portion. Other needs with regard to the prior art include cost reduction, resource saving, easy manufacture and improvement of the usability.

SUMMARY

In order to solve at least part of the problems described above, the invention may be implemented by aspects described below.

(1) According to one aspect of the invention, there is provided a cartridge that is mountable to a liquid ejection apparatus that comprises a pressurizing mechanism that is configured to supply a pressurized fluid and a liquid ejection assembly that is configured to eject a liquid. The cartridge comprises a liquid container that is at least partly made of a flexible material and is configured to contain the liquid therein; a recess that is configured to be open toward a mounting direction of the cartridge to the liquid ejection apparatus; and a fluid receiving portion that is placed inside of the recess and is configured to receive supply of the pressurized fluid.

In the cartridge of this aspect, the fluid receiving portion is placed in the recess that is open toward the mounting direction. This configuration reduces the likelihood that an external force is directly applied to the fluid receiving portion and the likelihood that any foreign substance such as liquid adheres to the fluid receiving portion.

(2) The cartridge of the above aspect may further comprise a first positioning portion that is to be engaged with a first apparatus-side positioning portion; and a second positioning portion that is to be engaged with a second apparatus-side positioning portion. The fluid receiving portion may be located between the first positioning portion and the second positioning portion.

In the cartridge of this aspect, the fluid receiving portion is located between the first positioning portion and the second positioning portion. This configuration suppresses a positional misalignment of the fluid receiving portion relative to the liquid ejection apparatus.

(3) The cartridge of the above aspect may comprise a plurality of the fluid receiving portions.

This configuration reduces the likelihood that an external force is directly applied to the plurality of fluid receiving portions and the likelihood that any foreign substance such as liquid adheres to the plurality of fluid receiving portions.

(4) The cartridge of the above aspect may further comprise a liquid outflow portion that is configured to flow out the liquid contained in the liquid container toward the liquid ejection apparatus and is arranged to have a center axis that is extended in a predetermined direction. The plurality of fluid receiving portions may include a first fluid receiving portion and a second fluid receiving portion. The first fluid receiving portion and the second fluid receiving portion may be arranged across a virtual plane that passes through the center axis and is parallel to a vertical direction in a mounting state of the cartridge that the cartridge is mounted to the liquid ejection apparatus.

In the cartridge of this aspect, the first fluid receiving portion and the second fluid receiving portion are arranged across the virtual plane that passes through the center axis of the liquid outflow portion. This configuration reduces the likelihood that the cartridge is inclined about the liquid outflow portion.

(5) The cartridge of the above aspect may further comprise a pressurizing chamber that is arranged to receive the supply of the pressurized fluid from the liquid ejection apparatus by at least one of the plurality of fluid receiving portions and is configured to press the liquid container by the supplied pressurized fluid, in order to supply the liquid contained in the liquid container to the liquid ejection apparatus; and a stirring portion that is arranged to receive the supply of the pressurized fluid from the liquid ejection apparatus by at least different one of the plurality of fluid receiving portions and is configured to press the liquid container and stir the liquid contained in the liquid container.

This configuration uses the pressurized fluid to supply the liquid contained in the liquid container to the liquid ejection apparatus and stir the liquid contained in the liquid container.

(6) According to another aspect of the invention, there is provided a cartridge unit. The cartridge unit comprises a cartridge of the above aspect as a first cartridge; and another cartridge according of the above aspect as a second cartridge. When the pressurizing chamber of the first cartridge receives the supply of the pressurized fluid, the pressurizing chamber of the second cartridge does not receive the supply of the pressurized fluid. In each of the first and the second cartridges, the stirring portion receives the supply of the pressurized fluid when the pressurizing chamber does not receive the supply of the pressurized fluid.

This configuration enables the liquid contained in the liquid container to be stirred by the stirring portion, while the pressurizing chamber does not receive the supply of the pressurized fluid.

(7) According to another aspect of the invention, there is provided a liquid ejection system. The liquid ejection system comprises a liquid ejection apparatus and the cartridge of the above aspect or the cartridge unit of the above aspect.

This configuration reduces the likelihood that an external force is directly applied to the fluid receiving portion and the likelihood that any foreign substance such as liquid adheres to the fluid receiving portion.

All the plurality of components included in each of the aspects of the invention described above are not essential, but some components among the plurality of components may be appropriately changed, omitted or replaced with other components or part of the limitations may be deleted, in order to solve part or all of the problems described above or in order to achieve part or all of the advantageous effects described herein. In order to solve part or all of the problems described above or in order to achieve part or all of the advantageous effects described herein, part or all of the technical features included in one aspect of the invention described above may be combined with part or all of the technical features included in another aspect of the invention described above to provide still another independent aspect of the invention.

For example, one aspect of the invention may be implemented as an apparatus comprising one or more components among the plurality of components, i.e., the liquid container, the fluid receiving portion and the recess. More specifically, this apparatus may have or may not have the liquid container. This apparatus may have or may not have the recess. This configuration solves at least one of the various problems, for example, downsizing of the apparatus, cost reduction, resource saving, easy manufacture, and improvement of the usability. Part or all of the technical features in each of the aspects of the cartridge or the liquid ejection system described above may be applied to this apparatus.

The invention may be implemented by any of various aspects other than the cartridge and the liquid ejection system, for example, a method of manufacturing the cartridge, a mounting structure for mounting the cartridge to a liquid ejection apparatus, and a liquid supply apparatus.

DESCRIPTION OF THE EMBODIMENTS

A. First Embodiment

A-1. Description of Liquid Ejection System 1

Figure 1:
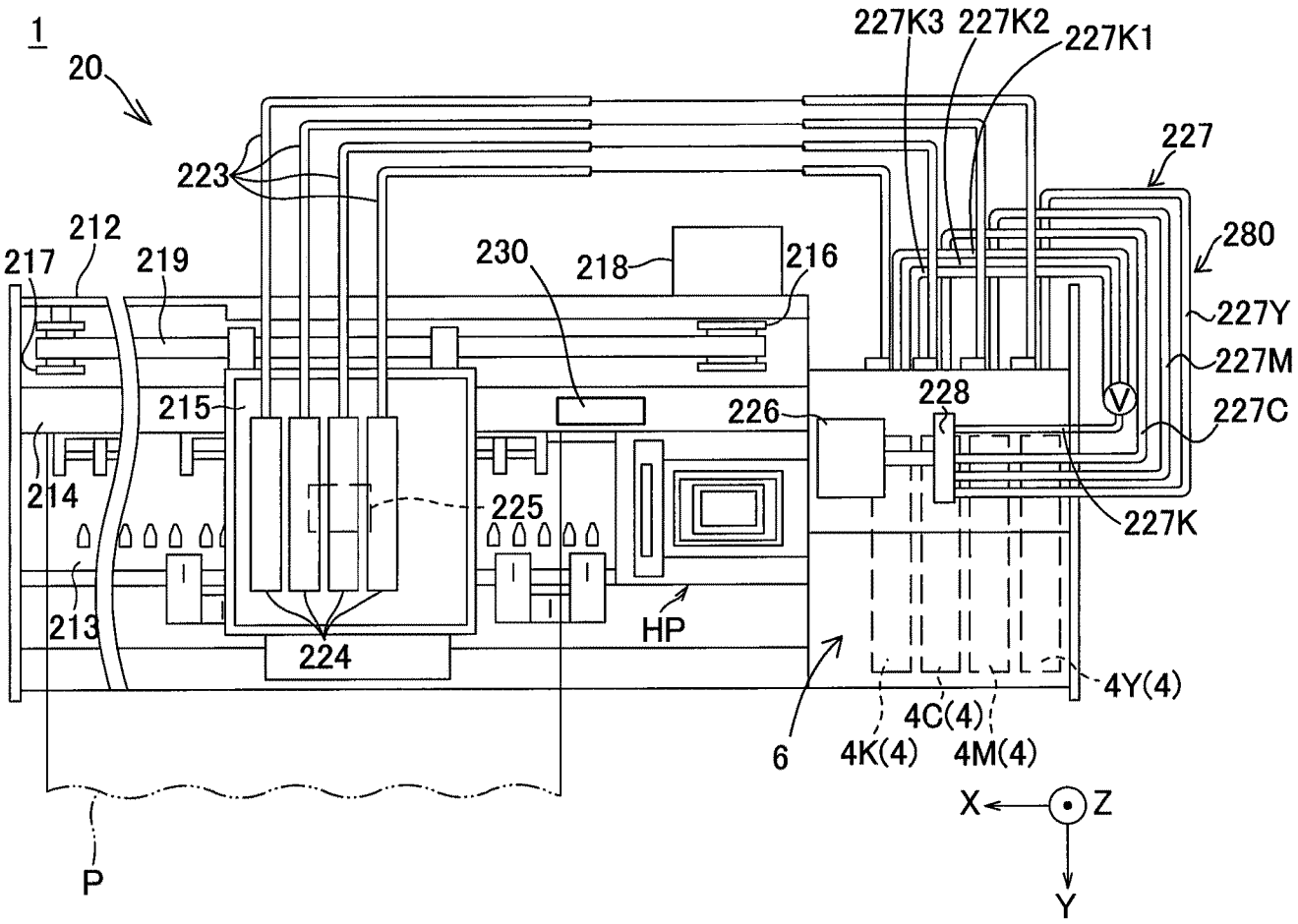
FIG. 1 is a schematic configuration diagram illustrating a liquid ejection system according to a first embodiment of the invention.

FIG. 1 is a schematic configuration diagram illustrating a liquid ejection system 1 according to a first embodiment of the invention. X, Y and Z axes that are three space axes perpendicular to one another are illustrated in FIG. 1. The directions of the arrows of the X axis, the Y axis and the Z axis respectively indicate positive directions along the X axis, the Y axis and the Z axis. The positive directions along the X axis, the Y axis and the Z axis are respectively expressed as +X-axis direction, +Y-axis direction and +Z-axis direction. The opposite directions to the directions of the arrows of the X axis, the Y axis and the Z axis respectively indicate negative directions along the X axis, the Y axis and the Z axis. The negative directions along the X axis, the Y axis and the Z axis are respectively expressed as −X-axis direction, −Y-axis direction and −Z-axis direction. When there is no need for discrimination between positive and negative directions, the directions along the X axis, the Y axis and the Z axis are respectively expressed as X-axis direction, Y-axis direction and Z-axis direction. The same applies to the subsequent drawings and the following description. The X, Y and Z axes shown in the other drawings indicate the directions corresponding to the X, Y and Z axes shown in FIG. 1. In the use state of the liquid ejection system 1 (printer 20), the +Z-axis direction indicates vertically upward direction and the −Z-axis direction indicates vertically downward direction. The "use state of the liquid ejection system 1 (printer 20)" herein means that the state that the liquid ejection system 1 is placed on a horizontal mounting surface that is defined by the X-axis direction and the Y-axis direction.

The liquid ejection system 1 includes a printer 20 as a liquid ejection apparatus and four cartridges 4C, 4M, 4Y and 4K. The printer 20 is an inkjet printer configured to eject (jet) ink as a liquid from a record head 225 as a liquid ejection assembly. When there is no need for discrimination among the four cartridges 4C, 4M, 4Y and 4K, these cartridges are expressed by a symbol "4". The cartridge 4 is also called "adapter 4".

The printer 20 includes a main body casing 212 of an approximately rectangular box shape and a controller 230 placed inside of the main body casing 212. The controller 230 is configured to control various operations (for example, printing operation) of the printer 20 and transmit various signals to and from the cartridges 4.

A platen 213 is placed in the main body casing 212 to be arranged along the longitudinal direction (X-axis direction) of the main body casing 212. The platen 213 serves as a support base to support recording paper P as an ejection object. The recording paper P is fed onto the platen 213 along a sub-scanning direction that is perpendicular to a main scanning direction (X-axis direction) by a paper feed mechanism (not shown).

The printer 20 also includes a guide shaft 214, a carriage 215, a drive pulley 216, a driven pulley 217 and a carriage motor 218.

The guide shaft 214 is located on the +Z-axis direction side of the platen 213. The guide shaft 214 is a rod-like member provided along the main scanning direction. The carriage 215 is supported on the guide shaft 214 to be movable along the guide shaft 214.

The drive pulley 216 and the driven pulley 217 are arranged to be rotatable at positions that are located on the −Y-axis direction side of the guide shaft 214 and correspond to the respective ends of the guide shaft 214. A carriage motor 218 is linked with the drive pulley 216. An endless timing belt 219 supporting the carriage 215 is disposed between the pair of pulleys 216 and 217. The carriage motor 218 is driven to move the carriage 215 back and forth along the guide shaft 214 in the main scanning direction. According to this embodiment, the record head 225 is configured to move back and forth in the main scanning direction. This configuration is, however, not restrictive. For example, the record head 225 may be a line head that is extended along the X-axis direction and is placed at a fixed position.

The printer 20 includes a cartridge mounting assembly (holder) 6 to detachably mount the cartridges 4. The cartridge mounting assembly 6 is placed inside of the main body casing 212. Part of the main body casing 212 is configured to be openable. Opening this openable part enables the cartridge 4 to be mounted to and demounted from the cartridge mounting assembly 6. The cartridge mounting assembly 6 is placed inside of the main body casing 212 according to this embodiment, but this configuration is not restrictive. For example, the cartridge mounting assembly 6 may be placed outside of the main body casing 212.

The four cartridges 4C, 4M, 4K and 4Y are detachably mounted to the cartridge mounting assembly 6. The cartridge 4K contains black ink. The cartridge 4C contains cyan ink. The cartridge 4M contains magenta ink. The cartridge 4Y contains yellow ink. Each of the inks is a pigment ink including a dispersion medium such as water and pigment particles. The printer 20 has four liquid flow passages 223 corresponding to the four cartridge 4C, 4M, 4K and 4Y. The liquid flow passages 223 are formed by tubes. The liquid flow passage 223 is arranged to communicate the cartridge 4 with the record head 225.

In the case where the cartridges 4 are mounted to the cartridge mounting assembly 6, the cartridges 4 are respectively connected with upstream ends of the corresponding liquid flow passages 223. Downstream ends of the liquid flow passages 223 are respectively connected with upstream sides of valve units 224 mounted on the carriage 215. Downstream sides of the valve units 224 are connected with the record head 225 that is provided as the liquid ejection head on a lower surface side (−Z-axis direction side) of the carriage 215. The inks contained in the respective cartridges 4 accordingly flow through the liquid flow passages 223 and are supplied to the record head 225.

A home position HP is provided between the cartridge mounting assembly 6 and the platen 213 as a rest position of the record head 225. For example, prior to start of printing, various maintenance operations such as cleaning of the record head 225 are performed at this home position HP.

The printer 20 further includes a pressurizing mechanism 280 configured to supply a pressurized fluid to the cartridges 4. The pressurizing mechanism 280 is placed inside of the main body casing 212. The pressurizing mechanism 280 includes a pressurizing pump 226 as a supply source of the pressurized air as the pressurized fluid and a plurality of fluid flow passages 227 to flow the pressurized air to the cartridges 4.

The pressurizing pump 226 is connected with upstream ends of the fluid flow passages 227. The fluid flow passages 227 are formed by tubes. The fluid flow passages 227 are formed by branching at a distributor 228 placed downstream of the pressurizing pump 226. Downstream ends of the respective branched fluid flow passages 227 are connected with the corresponding cartridges 4.

Fluid flow passages 227C, 227M and 227Y are respectively provided corresponding to the cartridges 4C, 4M and 4Y in one-to-one correspondence. A fluid flow passage 227K corresponding to the cartridge 4K is, on the other hand, branched into three on the downstream side (cartridge 4K-side) of a valve V. The three branched flow passages are called first fluid flow passage 227K1, second fluid flow passage 227K2 and third fluid flow passage 227K3. The controller controls the operations of the pressurizing mechanism 280 including the pressurizing pump 226 and the valve V to supply the pressurized fluid through the fluid flow passages 227 to the corresponding cartridges 4.

The fluid flow passages 227K1, 227C, 227M and 227Y are arranged to flow the pressurized air for the purpose of supplying the inks contained in the corresponding cartridges 4 to the record head 225. The fluid flow passages 227K1, 227C, 227M and 227Y are arranged to flow the pressurized air to pressurizing chambers (described later) of the corresponding cartridges 4. This presses a liquid container of each cartridge 4. Pressing the liquid container causes the corresponding ink to flow through the liquid flow passage 223 and to be supplied to the record head 225.

The second fluid flow passage 227K2 and the third fluid flow passage 227K3 are arranged to flow the pressurized air for the purpose of stirring the liquid container of the cartridge 4K. More specifically, the second fluid flow passage 227K2 and the third fluid flow passage 227K3 are arranged to flow the pressurized air to a stirring member (described later) of the cartridge 4K.

The three fluid flow passages 227K1 to 227K3 are provided corresponding to the cartridge 4K according to this embodiment, but this configuration is not restrictive. For example, the number of fluid flow passages 227K may be two or less or may be four or more. The fluid flow passages 227C, 227M and 227Y are respectively provided corresponding to the cartridges 4C, 4M and 4Y in one-to-one correspondence according to this embodiment, but this configuration is not restrictive. For example, the number of the fluid flow passages 227C, 227M or 227Y may be three like the fluid flow passages 227K for the cartridge 4K or may be any desired number. The pressurized air is fed by the common pressurizing pump 226 to the respective fluid flow passages 227K1, 227K2, 227K3, 227C, 227M and 227Y according to this embodiment, but this configuration is not restrictive. For example, a plurality of the pressurizing pumps 226 may be provided corresponding to the respective fluid flow passages 227K1, 227K2, 227K3, 227C, 227M and 227Y.

A-2. Detailed Configuration of Cartridge Mounting Assembly

Figure 2:
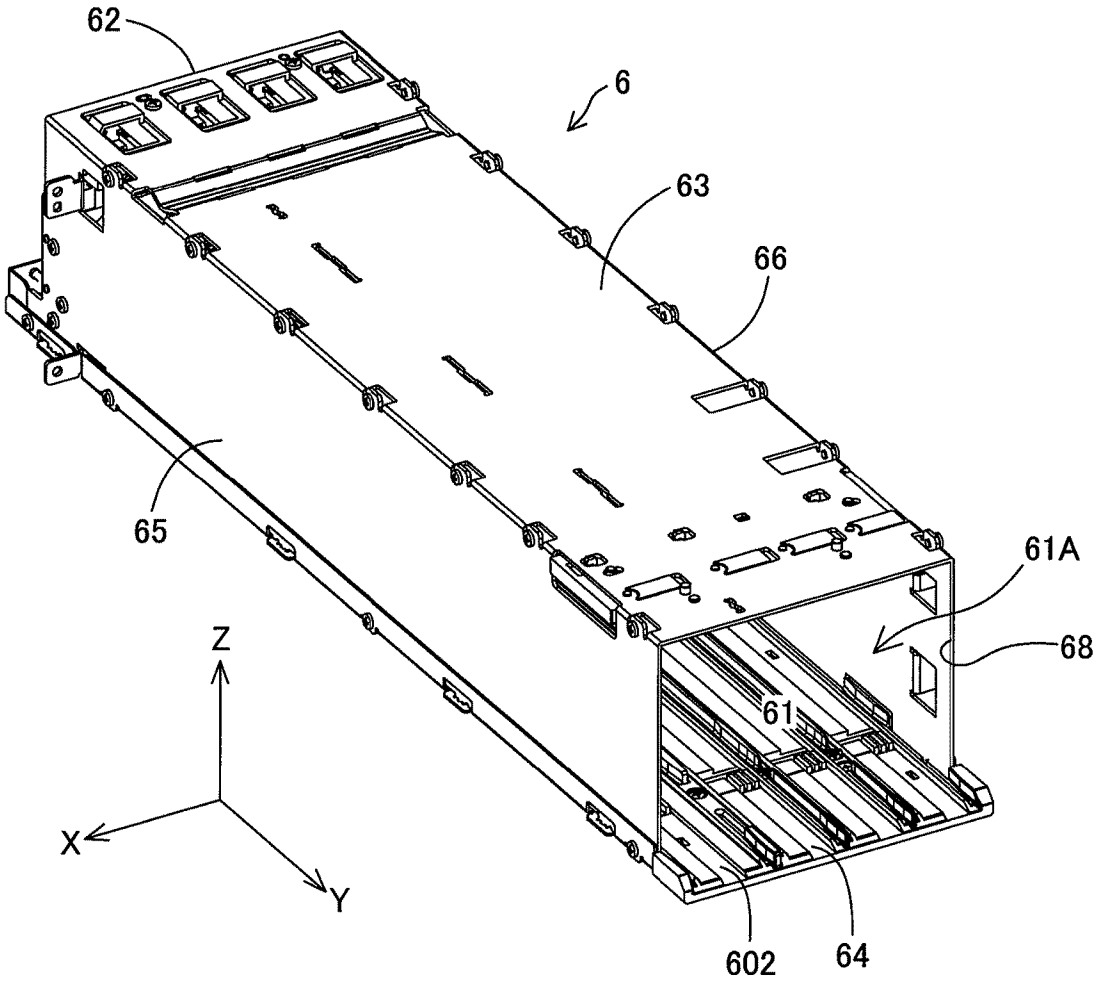
FIG. 2 is a first appearance perspective view illustrating a cartridge mounting assembly.
Figure 3:
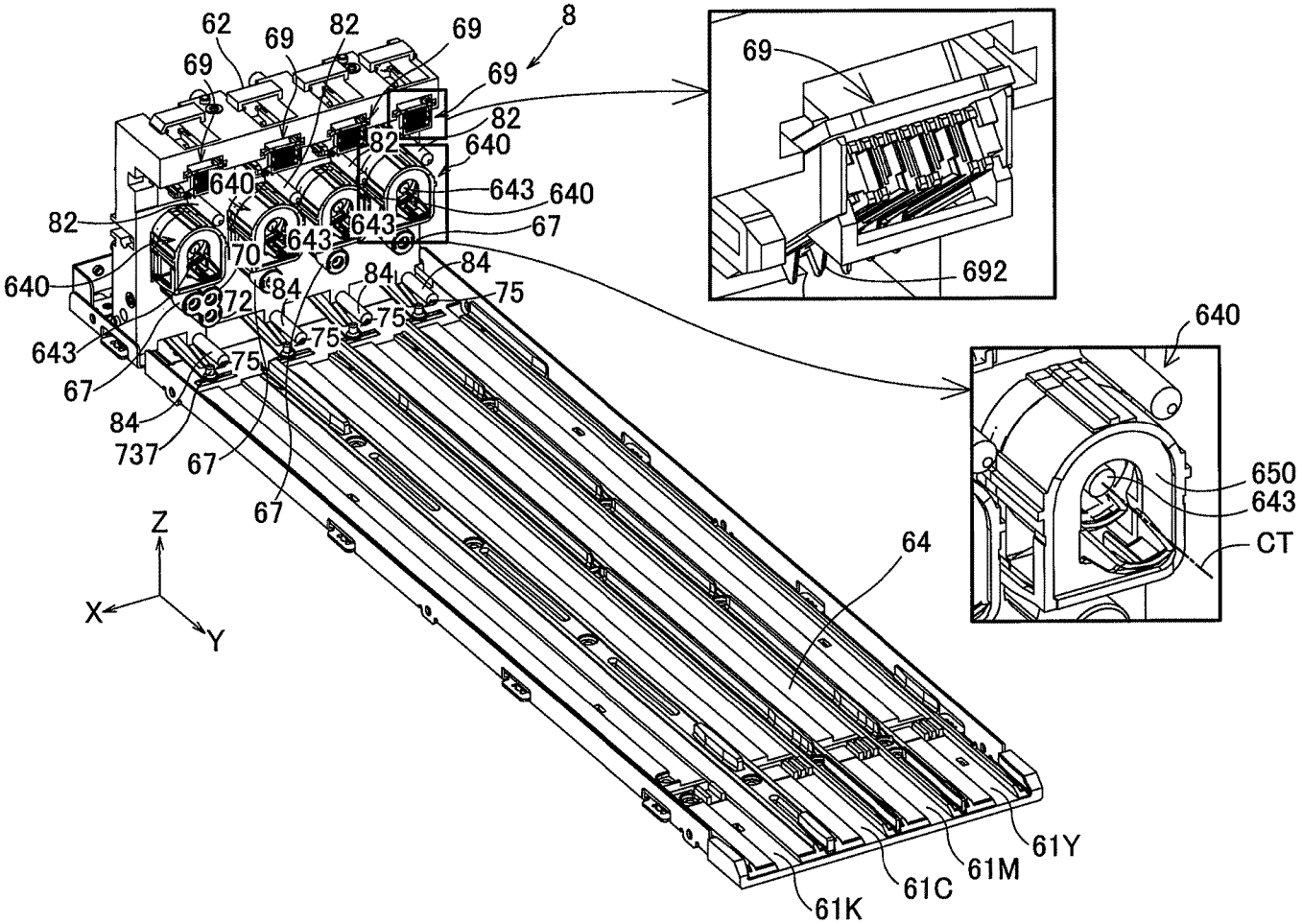
FIG. 3 is a second appearance perspective view illustrating the cartridge mounting assembly.

FIG. 2 is a first appearance perspective view illustrating the cartridge mounting assembly 6. FIG. 3 is a second appearance perspective view illustrating the cartridge mounting assembly 6. FIG. 3 omits part of the configuration from the illustration so as to make the internal configuration of the cartridge mounting assembly 6 visible. The mounting direction of the cartridge 4 to the cartridge mounting assembly 6 is −Y-axis direction. The demounting (pullout) direction of the cartridge 4 from the cartridge mounting assembly 6 is +Y-axis direction.

As shown in FIG. 2, the cartridge mounting assembly 6 includes six wall portions (described below) to form a cartridge chamber 61 that holds the cartridges 4 therein. The cartridge chamber 61 is in an approximately rectangular parallelepiped shape. Each portion of the cartridge chamber 61 for holding one of the four cartridges 4C, 4M, 4Y and 4K is called slot. More specifically, as shown in FIG. 3, a portion for holding the cartridge 4K is called slot 61K, a portion for holding the cartridge 4C is called slot 61C, a portion for holding the cartridge 4M is called slot 61M, and a portion for holding the cartridge 4Y is called slot 61Y.

The cartridge mounting assembly 6 includes an apparatus-side front wall portion 62, a first apparatus-side side wall portion 63 and a second apparatus-side side wall portion 64. The cartridge mounting assembly 6 also includes a third apparatus-side side wall portion 65, a fourth apparatus-side side wall portion 66 and an opening wall portion 61A. These six wall portions 62, 63, 64, 65, 66 and 61A are arranged to define and form the cartridge chamber 61. The six wall portions 62, 63, 64, 65, 66 and 61 are respectively formed in an approximately rectangular outer shape.

As shown in FIGS. 2 and 3, the apparatus-side front wall portion 62 is located on the −Y-axis direction side of the cartridge chamber 61. The apparatus-side front wall portion 62 is a vertical wall portion in the use state of the printer 20.

As shown in FIG. 3, the cartridge mounting assembly 6 includes apparatus-side terminal assembly 69, liquid supply mechanism 640, liquid supply pressurizing portion 67, first apparatus-side positioning portion 82, second apparatus-side positioning portion 84 and apparatus-side fixation structure 75. These components 69, 640, 67, 82, 84 and 75 are provided on the apparatus-side front wall portion 62. These components 69, 640, 67, 82, 84 and 75 are provided for each of the slots 61C, 61M, 61Y and 61K respectively corresponding to the cartridges 4C, 4M, 4Y and 4K. The cartridge mounting assembly 6 also includes a first stirring pressurizing portion 70 and a second stirring pressurizing portion 72 with respect to the cartridge 4K. The first stirring pressurizing portion 70 and the second stirring pressurizing portion 72 are provided on the apparatus-side front wall portion 62.

The apparatus-side terminal assembly 69 is placed vertically above (on the +Z-axis direction side of) the liquid supply mechanism 640. The apparatus-side terminal assembly 69 includes apparatus-side terminals 692. According to this embodiment, a plurality of (nine in this embodiment) apparatus-side terminals 692 are provided in the apparatus-side terminal assembly 69. The apparatus-side terminal 692 is made of an elastically deformable material. According to this embodiment, the apparatus-side terminal 692 is made from a leaf spring. The apparatus-side terminal 692 of this embodiment is configured to be elastically deformable along a plane defined by the Y-axis direction and the Z-axis direction. Each of the apparatus-side terminals 692 comes in contact with a cartridge-side terminal (described later) of the cartridge 4 to be electrically connected with the cartridge-side terminal. The apparatus-side terminals 692 are electrically connected with the controller 230 of the printer 20 by wiring (not shown). In the mounting state that the cartridge 4 is mounted to the cartridge mounting assembly 6, this connection enables various signals (for example, information regarding the remaining amount of ink) to be sent and received between the cartridge 4 and the controller 230.

The liquid supply mechanism 640 includes a cover member 650 and a liquid supply portion (liquid receiving tube) 643. The liquid supply portion 643 is used to flow the ink in the cartridge 4 toward the printer 20. The liquid supply portion 643 is formed in a tubular shape having a center axis CT extended along the Y-axis direction. The liquid supply portion 643 is connected with the cartridge 4.

The cover member 650 is arranged to surround the periphery of the liquid supply portion 643 about the center axis CT. The cover member 650 is a member for reducing the likelihood that ink is scattered out in the course of mounting or demounting the cartridge 4. The cover member 650 is pressed toward the +Y-axis direction by a pressing member (not shown, coil spring in this embodiment) included in the liquid supply mechanism 640. The cover member 650 is configured to be movable along the Y-axis direction. In the case of mounting the cartridge 4, the cartridge 4 comes in contact with the cover member 650, so that the cover member 650 moves in the −Y-axis direction against the pressing force of the pressing member. This causes a +Y-axis direction end of the liquid supply portion 643 to be protruded toward the +Y-axis direction of the cover member 650 and connected with the cartridge 4.

The liquid supply pressurizing portion 67 is a tubular member configured to flow the pressurized air as the pressurized liquid for supplying ink in the cartridge 4 to the record head 225. Each of the liquid supply pressurizing portions 67 is connected with one end portion (downstream end portion) of corresponding one of the fluid flow passages 227K1, 227C, 227M and 227Y (shown in FIG. 1). The liquid supply pressurizing portion 67 is connected with the cartridge 4 in the mounting state of the cartridge 4. A tubular seal member is placed on an inner circumferential surface of the liquid supply pressurizing portion 67. This seal member is made of, for example, rubber.

The first apparatus-side positioning portion 82 is a member that is protruded toward the +Y-axis direction from the apparatus-side front wall portion 62. The first apparatus-side positioning portion 82 is a columnar member (rod-like member). The first apparatus-side positioning portion 82 is located between the apparatus-side terminal assembly 69 and the liquid supply mechanism 640 in the vertical direction. A leading end portion (+Y-axis direction end portion) of the first apparatus-side positioning portion 82 is located on the +Y-axis direction side of the apparatus-side terminals 692, the liquid supply portion 643, the liquid supply pressurizing portion 67, the first stirring pressurizing portion 70 and the second stirring pressurizing portion 72.

The second apparatus-side positioning portion 84 is formed in the same shape as that of the first apparatus-side positioning portion 82. More specifically, the second apparatus-side positioning portion 84 is a member that is protruded toward the +Y-axis direction from the apparatus-side front wall portion 62. The second apparatus-side positioning portion 84 is a columnar member (rod-like member). The second apparatus-side positioning portion 84 is located vertically below the liquid supply mechanism 640 and the liquid supply pressurizing portion 67. The second apparatus-side positioning portion 84 is located vertically below the first apparatus-side positioning portion 82. A leading end portion (+Y-axis direction end portion) of the second apparatus-side positioning portion 84 is located on the +Y-axis direction side of the apparatus-side terminals 692 and the liquid supply portion 643.

The first and the second apparatus-side positioning portions 82 and 84 serve to position the cartridge 4 in the case of mounting the cartridge 4. More specifically, the first and the second apparatus-side positioning portions 82 and 84 serve to position the cartridge 4 in a direction crossing the mounting direction of the cartridge 4 (−Y-axis direction).

The apparatus-side fixation structure 75 serves to fix the cartridge 4 to the cartridge mounting assembly 6 in the mounting state. The apparatus-side fixation structure 75 includes a locking pin 737 that is configured to engage with the cartridge 4 in the mounting state. The apparatus-side fixation structure 75 fixes the cartridge 4 to the cartridge mounting assembly 6 by such engagement. In the mounting state, the cartridge 4 receives a pressing force toward the +Y-axis direction by the cover member 650. The engagement of the apparatus-side fixation structure 75 with the cartridge 4 restricts the move of the cartridge 4 in the +Y-axis direction by this pressing force. In other words, the apparatus-side fixation structure 75 restricts the move of the cartridge 4 in the +Y-axis direction in the mounting state. The apparatus-side fixation structure 75 includes a portion that is located on the +Y-axis direction side of the apparatus-side front wall portion 62. At least part of the apparatus-side fixation structure 75 and at least part of the second apparatus-side positioning portion 84 are positioned at the same height.

The first stirring pressurizing portion 70 is a tubular member configured to flow the pressurized air for stirring the liquid container of the cartridge 4K. The first stirring pressurizing portion 70 is connected with one end portion (downstream end portion) of the second fluid flow passage 227K2 (shown in FIG. 1). The first stirring pressurizing portion 70 is connected with the cartridge 4K in the mounting state of the cartridge 4K. A tubular seal member is placed on an inner circumferential surface of the first stirring pressurizing portion 70. This seal member is made of, for example, rubber.

The second stirring pressurizing portion 72 is a tubular member configured to flow the pressurized air for stirring the liquid container of the cartridge 4K. The second stirring pressurizing portion 72 is connected with one end portion (downstream end portion) of the third fluid flow passage 227K3 (shown in FIG. 1). The second stirring pressurizing portion 72 is connected with the cartridge 4K in the mounting state of the cartridge 4K. A tubular seal member is placed on an inner circumferential surface of the second stirring pressurizing portion 72. This seal member is made of, for example, rubber.

A-3. Schematic Configuration of Cartridge 4K

Figure 4:
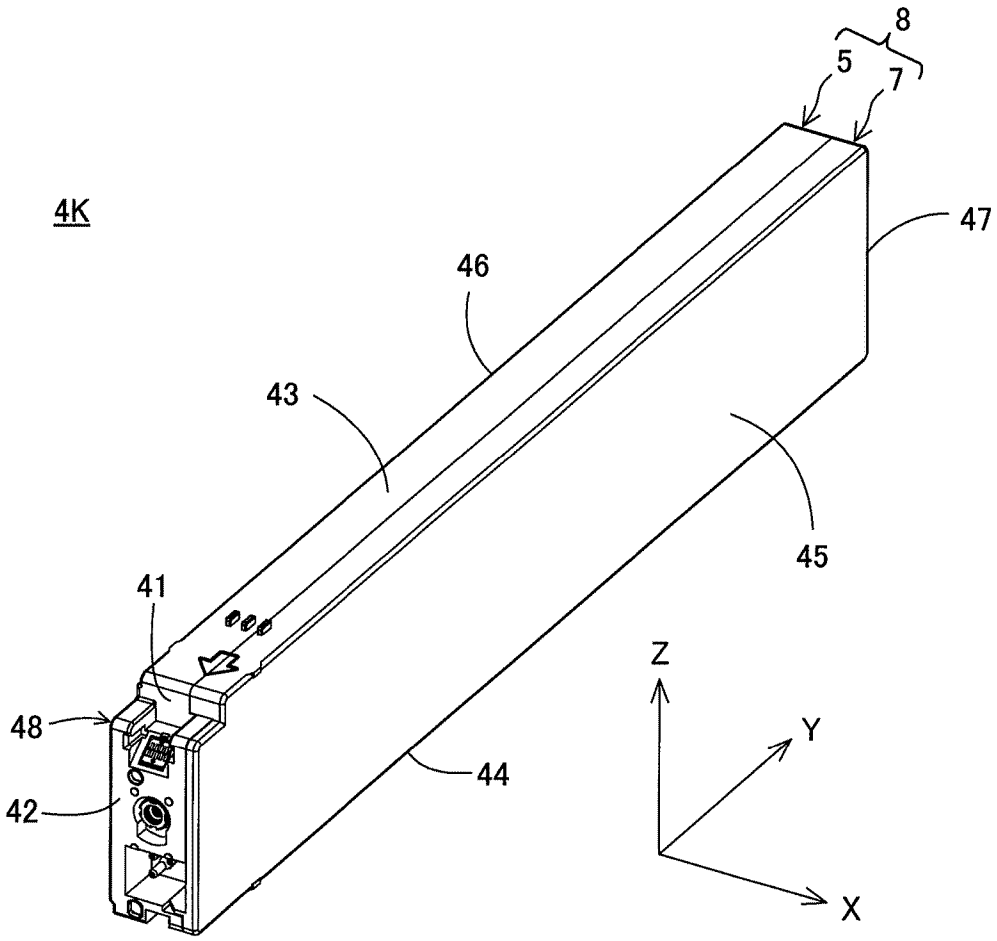
FIG. 4 is an appearance perspective view illustrating a cartridge.
Figure 5:
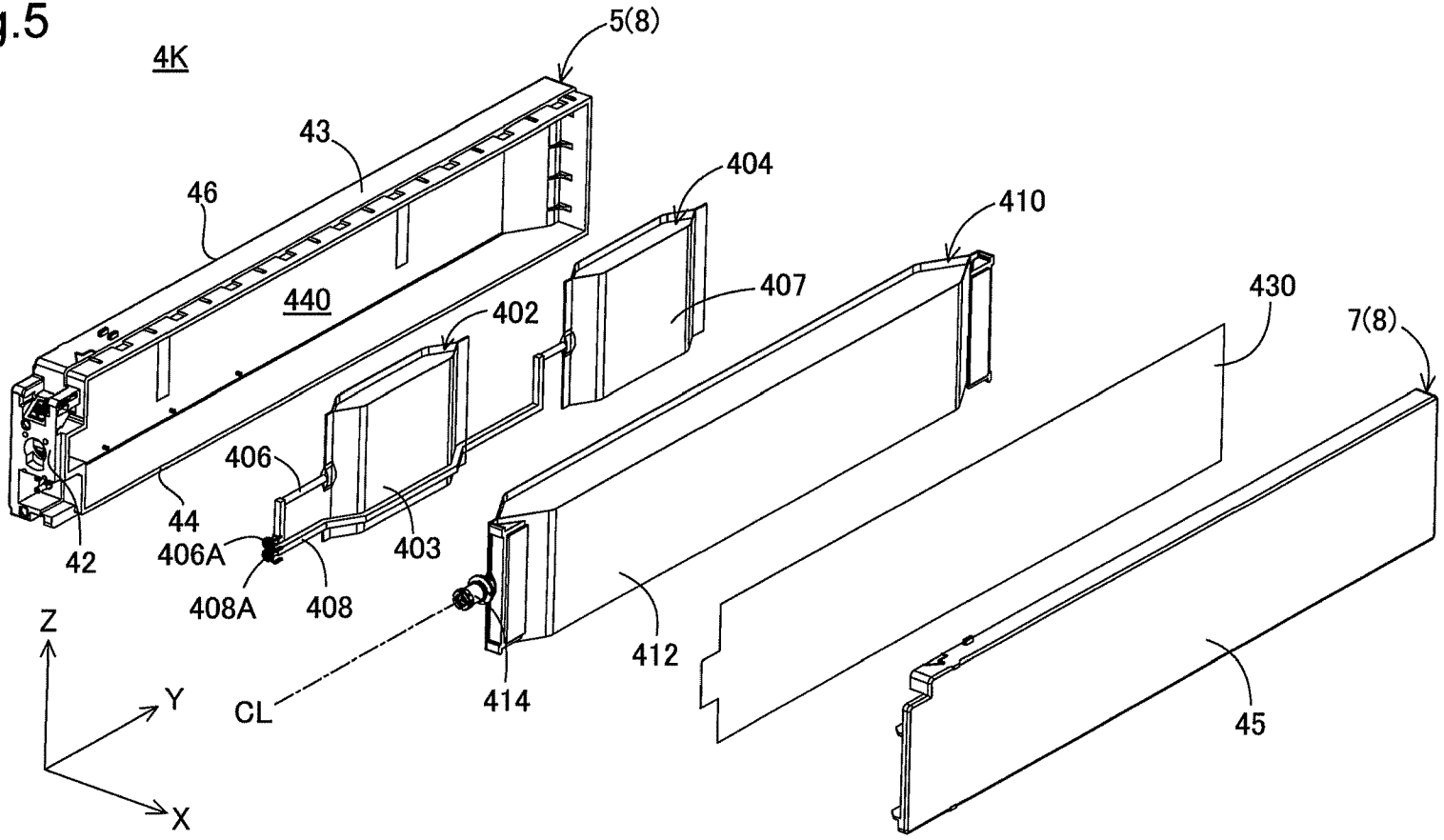
FIG. 5 is an exploded perspective view illustrating the cartridge.
Figure 6:
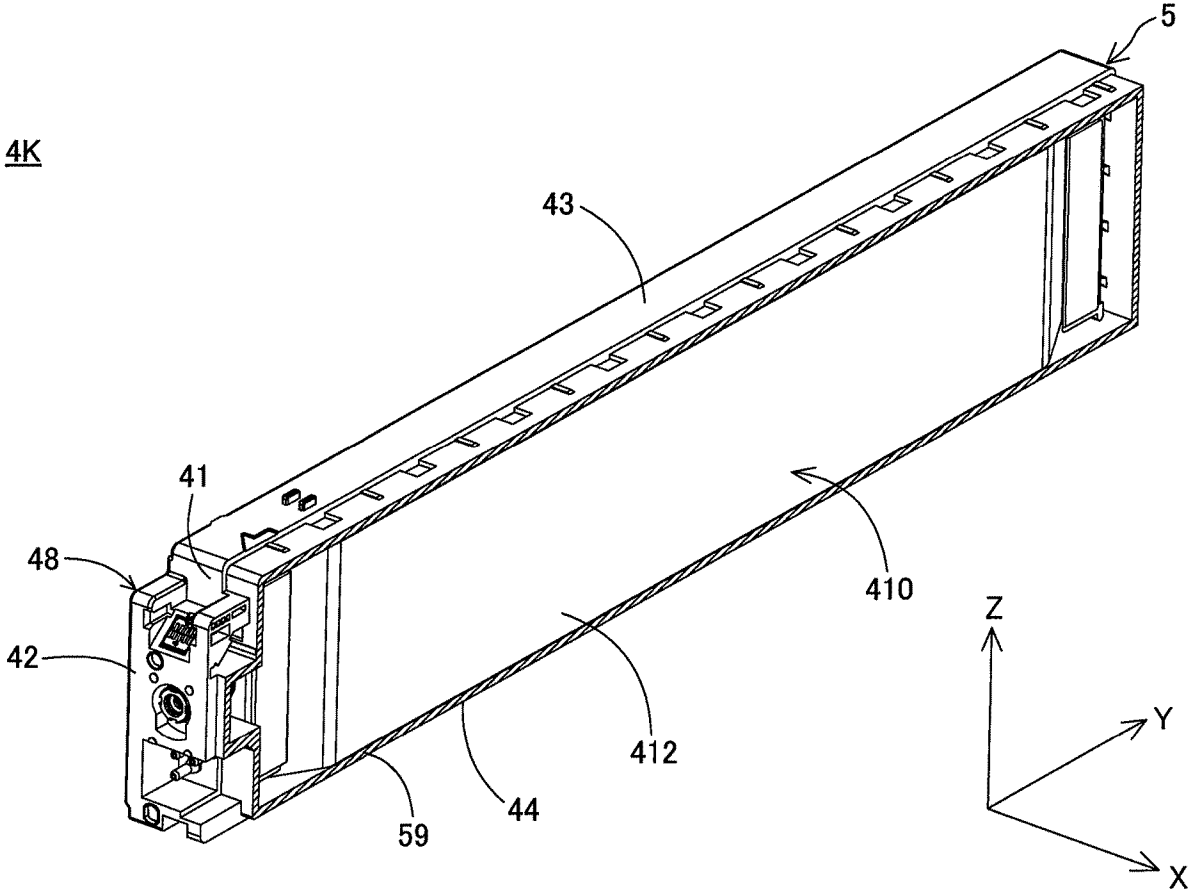
FIG. 6 is a diagram illustrating the state that a second casing is detached from the cartridge.

FIG. 4 is an appearance perspective view illustrating the cartridge 4K. FIG. 5 is an exploded perspective view illustrating the cartridge 4K. FIG. 6 is a diagram illustrating a state that a second casing 7 is detached from the cartridge 4K. X, Y and Z axes in the mounting state of the cartridge 4K are illustrated in FIGS. 4 to 6. The X, Y and Z axes in the mounting state of the cartridge 4K are also shown in subsequent drawings as appropriate.

The cartridge 4K is in an approximately rectangular parallelepiped outer shape as shown in FIG. 4. The dimensions of the cartridge 4K decrease in the sequence of the Y-axis direction, the Z-axis direction and the X-axis direction. The cartridge 4K includes a casing 8 that forms the outer shell. The casing 8 is a housing formed by molding a synthetic resin such as polypropylene or polystyrene.

The cartridge 4 includes a front surface (front wall) 42, a rear surface (rear wall) 47, a first side surface (first side wall) 43, a second side surface (second side wall) 44, a third side surface (third side wall) 45, and a fourth side surface (fourth side wall) 46. The cartridge 4 further includes a second surface (second wall, second front wall) 41 that is located on the +Y-axis direction side of the front surface 42. The second surface 41 and the front surface 42 are surfaces arranged to face in the mounting direction (−Y-axis direction).

In the description, the first side surface 43 is also called upper surface 43, and the second side surface 44 is also called bottom surface 44. The third side surface 45 is also called right side surface 45, and the fourth side surface 46 is also called left side surface 46. The front surface 42 and the rear surface 47 are opposed to each other in the Y-axis direction. The front surface 42 is located on the −Y-axis direction (mounting direction) side, and the rear surface 47 is located on the +Y-axis direction side. The first side surface 43 and the second side surface 44 are arranged to intersect the front surface 42 and the rear surface 47 and are opposed to each other in the Z-axis direction. The first side surface 43 is located on the +Z-axis direction side, and the second side surface 44 is located on the −Z-axis direction side. The third side surface 45 and the fourth side surface 46 are arranged to intersect the front surface 42, the rear surface 47, the first side surface 43 and the second side surface 44 and are opposed to each other in the X-axis direction. The third side surface 45 is located on the +X-axis direction side, and the fourth side surface 46 is located on the −X-axis direction side. In the description hereof, "intersecting" two surfaces (elements) means one of the state that two surfaces (elements) actually intersect each other, the state that the extension of one surface (element) intersects the other surface (element) and the state that the respective extensions of the two surfaces intersect each other.

The X-axis direction is also called width direction of the cartridge 4K. The Y-axis direction is also called length direction of the cartridge 4K. The Z-axis direction is also called height direction of the cartridge 4K.

In other words, the front surface 42 is formed on a protruded portion 48 that is protruded in the −Y-axis direction from the second surface 41. The front surface 42 is in an approximately rectangular shape that has a dimension in the Z-axis direction is larger than a dimension in the X-axis direction. The front surface 42 is opposed to the apparatus-side front wall portion 62 (shown in FIG. 3) in the mounting state.

As shown in FIG. 5, the cartridge 4K includes a first casing 5, a second casing 7, a liquid container assembly 410, a sheet member (film) 430, a first stirring member 402 and a second stirring member 404. The first and the second casings 5 and 7 are formed by molding a synthetic resin. The casing 8 is formed by combining the first casing 5 with the second casing 7.

The first casing 5 is in a concave shape that has an opening on its +X-axis direction side. The first casing 5 mainly forms the front surface 42, the first side surface 43, the second side surface 44, the fourth side surface 46, the rear surface 47, the second surface 41 and the protruded portion 48.

The sheet member 430 is a thin film member. The sheet member 430 is air-tightly joined with an end face 59 that defines the opening of the first casing 5, so as to seal the opening. For the better understanding, the end face 59 is shown by hatching in FIG. 6. Air-tightly joining the sheet member 430 with the end face 59 defines and forms an inner chamber 440 that holds stirring portions 403 and 407 and a liquid container 412 (described later) therein. The inner chamber 440 receives the supply of the pressurized air flowing through the first fluid flow passage 227K1. The inner chamber 440 is configured to press the liquid container 412 by the supplied pressurized air. This pressurizes the ink contained in the liquid container 412. In the mounting state, the ink contained in the liquid container 412 is pressurized and is thereby supplied toward the printer 20. In other words, the inner chamber 440 serves as a pressurizing chamber to pressurize the ink contained in the liquid container 412, so as to supply the ink in the liquid container 412 to the printer 20.

The second casing 7 is attached to the first casing 5 to cover the sheet member 430. The second casing 7 mainly forms the right side surface 45. The first casing 5 and the second casing 7 are arranged to protect and suppress damages of the first stirring member 402, the second stirring member 404, the liquid container assembly 410 and the sheet member 430.

The liquid container assembly 410 includes the liquid container 412 and a liquid outflow portion (liquid flow port) 414. The liquid container 412 is configured to contain ink. The liquid container 412 is made of a material having flexibility. The liquid container 412 is a bag body. The volume of the liquid container 412 decreases with consumption of ink filled in the liquid container 412. The liquid container 412 may not necessarily be entirely made of the material having flexibility, but at least part of the liquid container 412 should be made of the material having flexibility.

The liquid outflow portion 414 is configured to flow the ink contained in the liquid container 412 as the liquid supply source toward the printer 20. In the mounting state of the cartridge 4K, inserting the liquid supply portion 643 of the tubular shape (shown in FIG. 3) into the liquid outflow portion 414 connects the liquid outflow portion 414 with the liquid supply portion 643. In the mounting process, connecting the liquid outflow portion 414 with the liquid supply portion 643 starts after the start of positioning engagement. The ink in the liquid container 412 flows through the liquid outflow portion 414 and the liquid supply portion 643 and is supplied to the record head 225 of the printer 20. The liquid outflow portion 414 has a center axis CL extended in a predetermined direction (Y-axis direction). The center axis CL is extended parallel to the mounting direction (−Y-axis direction). The liquid outflow portion 414 is a tubular member that enables ink to flow through inside. The liquid outflow portion 414 is connected with a +Y-axis direction end of the liquid container 412. A valve mechanism is placed in the liquid outflow portion 414. This valve mechanism is opened by connecting the liquid supply portion 643 with the liquid outflow portion 414.

The first stirring member 402 includes the first stirring portion 403 and a first fluid flow portion 406. The first stirring portion 403 is a bag body having flexibility. The first fluid flow portion 406 has one end connecting with the first stirring portion 403 and the other end 406A connecting with a first stirring fluid receiving portion (described later). The first fluid flow portion 406 is configured to flow the pressurized air supplied from the first stirring pressurizing portion 70 (shown in FIG. 3) to the first stirring portion 403.

The first stirring portion 403 receives the pressurized fluid supplied by the pressurizing pump 226 of the printer 20 (shown in FIG. 1). The outer shape of the first stirring portion 403 is expanded by the supplied pressurized fluid, so that the first stirring portion 403 presses the liquid container 412 and stirs the ink contained in the liquid container 412. This fluidizes the pigment particles accumulated in a −Z-axis direction part in the liquid container 412. Fluidization of the pigment particles reduces a variation in concentration distribution of the pigment particles in the ink contained in the liquid container 412. The first stirring portion 403 is arranged to be opposed to a main surface of the liquid container 412 (−X-axis direction side surface in this embodiment). Supplying the pressurized air increases the volume of the first stirring portion 403 and expands the outer shape of the first stirring portion 403. Stopping the supply of the pressurized air decreases the volume of the first stirring portion 403 and contracts the outer shape of the first stirring portion 403. Accordingly the outer shape of the first stirring portion 403 is repeatedly expanded and contracted by repeating the supply and the stop of the pressurized air. Expanding the outer shape of the first stirring portion 403 causes the liquid container 412 to be pressed by the first stirring portion 403.

The second stirring member 404 is arranged such that the second stirring portion 407 is located on the +Y-axis direction side of the first stirring portion 403. The second stirring member 404 includes the second stirring portion 407 and a second fluid flow portion 408. The second stirring portion 407 has the same configuration as that of the first stirring portion 403. The second fluid flow portion 408 has one end connecting with the second stirring portion 407 and the other end 408A connecting with a second stirring fluid receiving portion (described later). The second fluid flow portion 408 is configured to flow the pressurized air supplied from the second stirring pressurizing portion 72 (shown in FIG. 3) to the second stirring portion 407. Like the first stirring portion 403, the second stirring portion 407 is configured to press the liquid container 412 and thereby stir the ink contained in the liquid container 412. Like the first stirring portion 403, the outer shape of the second stirring portion 407 is repeatedly expanded and contracted by repeating the supply and the stop of the pressurized air. Expanding the outer shape of the second stirring portion 407 causes the liquid container 412 to be pressed by the second stirring portion 407.

The pressurized air is supplied alternately to the first stirring portion 403 and the second stirring portion 407. In other words, while the pressurized air is supplied to the first stirring portion 403, the supply of the pressurized air to the second stirring portion 407 is stopped. While the pressurized air is supplied to the second stirring portion 407, the supply of the pressurized air to the first stirring portion 403 is stopped.

According to this embodiment, the first and the second stirring members 402 and 404 are provided to stir the ink in the liquid container 412. The number of the stirring members is, however, not limited to this embodiment. For example, only the first stirring member 402 may be provided in the cartridge, or three or more stirring members may be provided in the cartridge.

Figure 7:
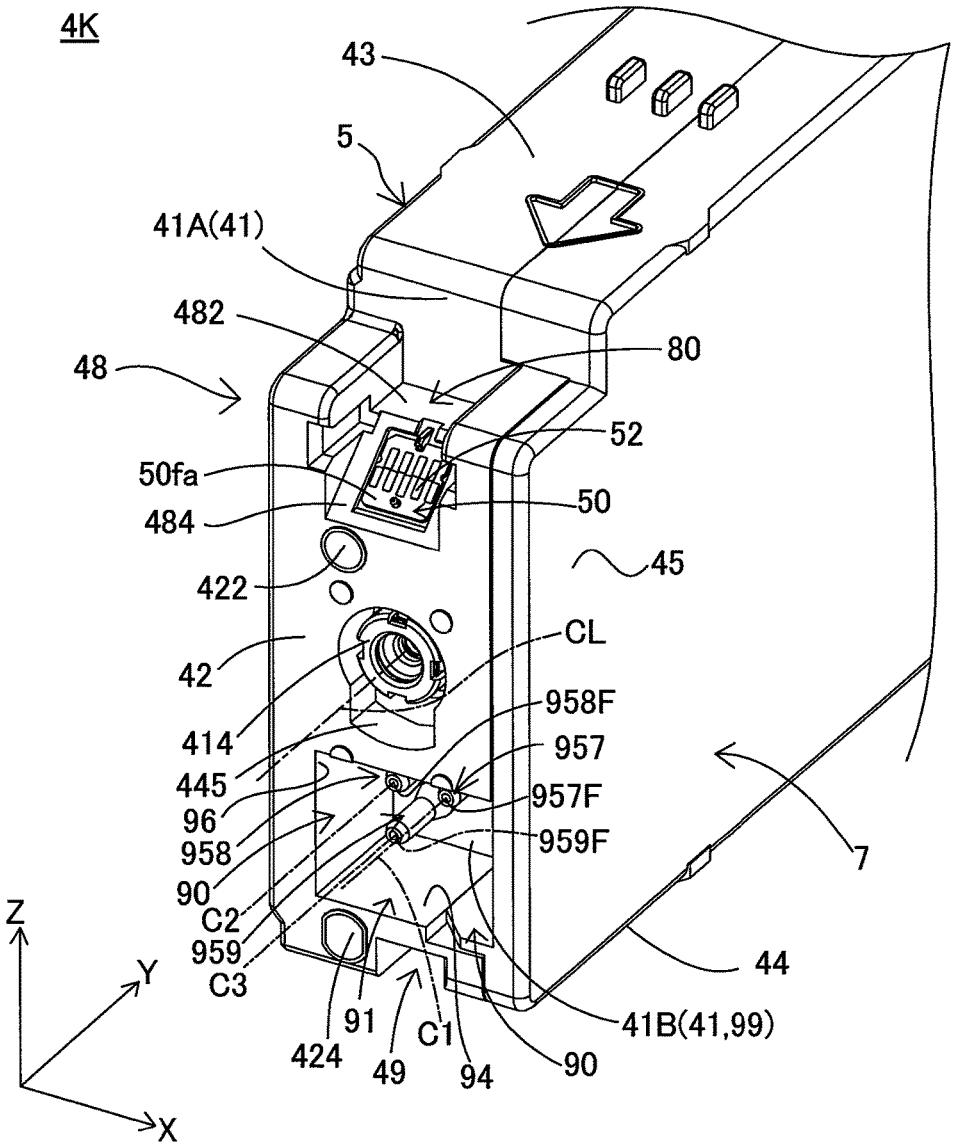
FIG. 7 is a first appearance perspective view illustrating a front surface side of the cartridge.
Figure 8:
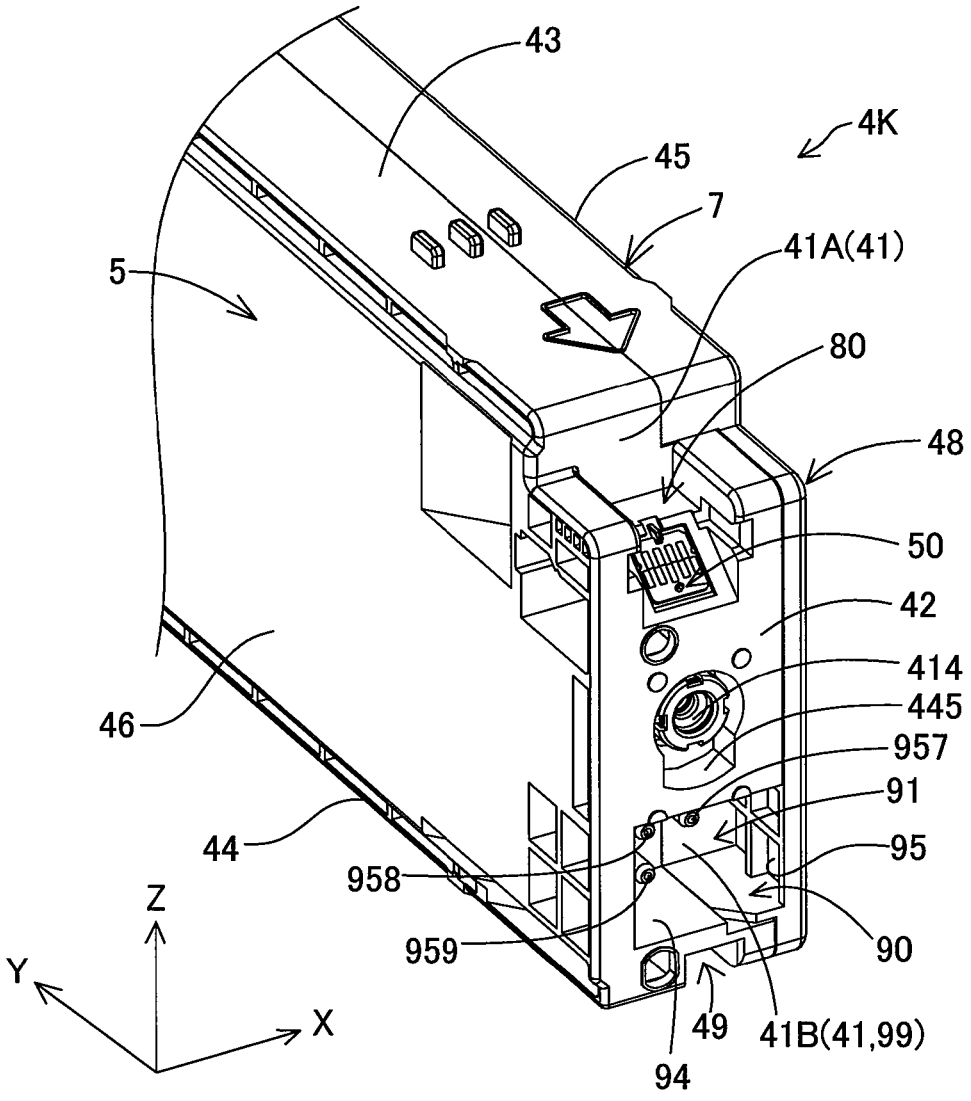
FIG. 8 is a second appearance perspective view illustrating the front surface side of the cartridge.
Figure 9:
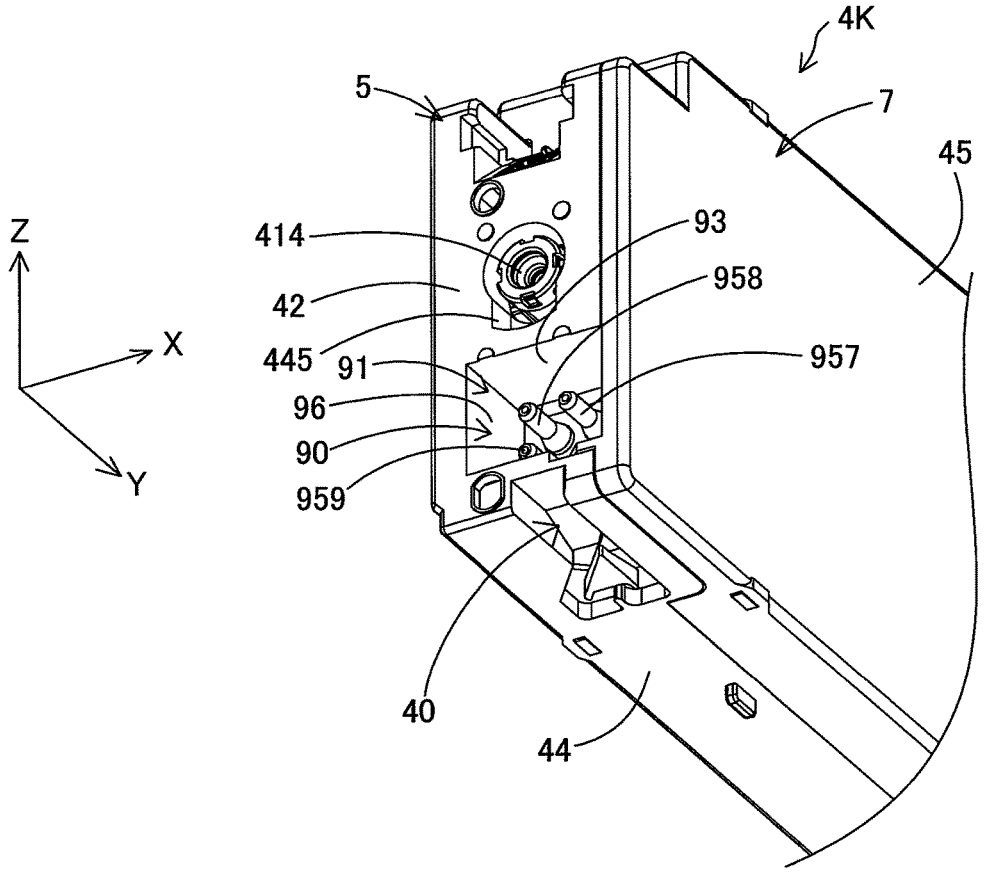
FIG. 9 is a third appearance perspective view illustrating the front surface side of the cartridge.
Figure 10:
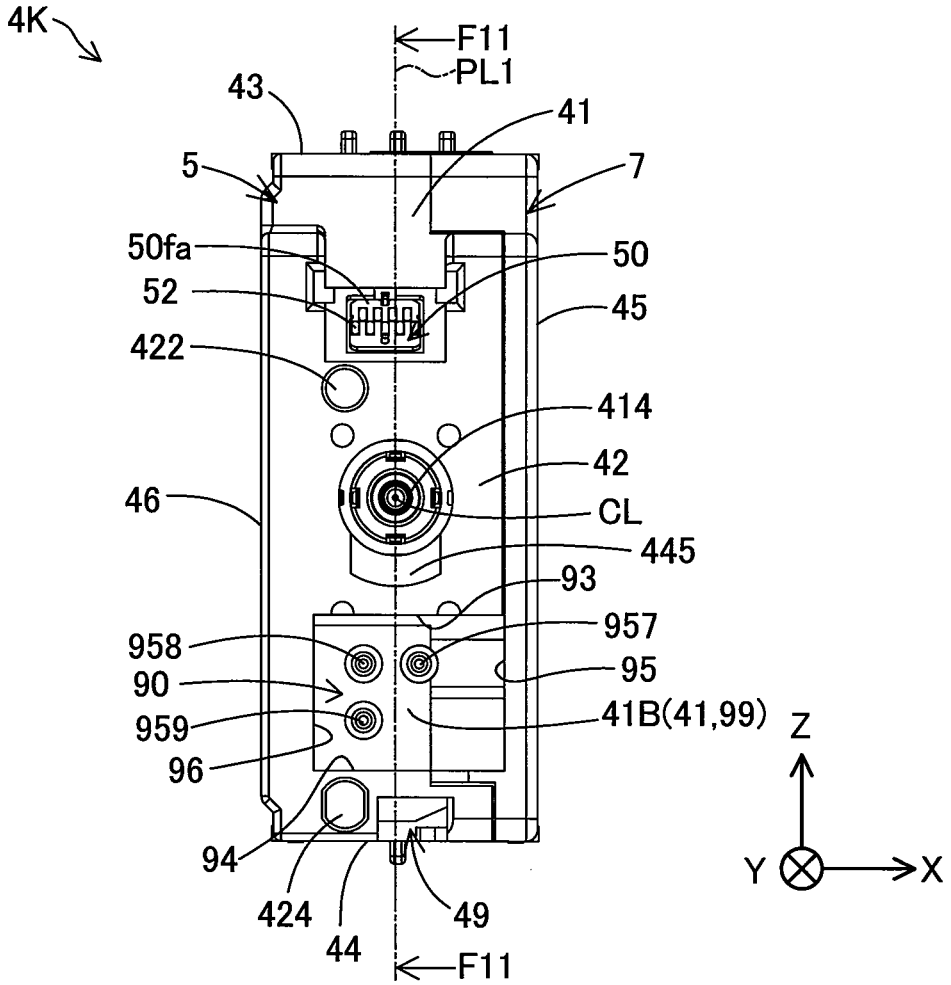
FIG. 10 is a front view illustrating the cartridge.
Figure 11:
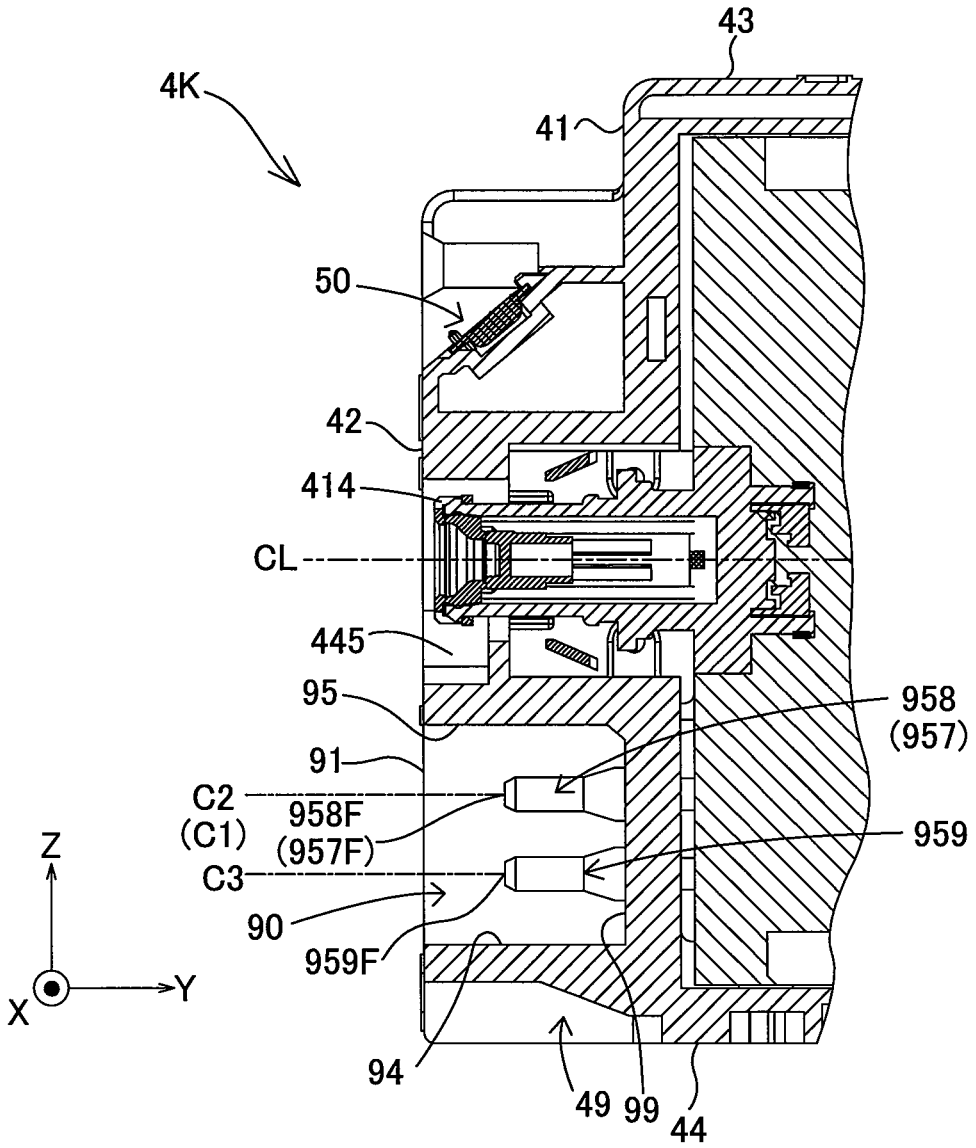
FIG. 11 is a partial sectional view illustrating the cartridge taken along an F11-F11 line in FIG. 10.

FIG. 7 is a first appearance perspective view illustrating the front surface 42-side of the cartridge 4K. FIG. 8 is a second appearance perspective view illustrating the front surface 42-side of the cartridge 4K. FIG. 9 is a third appearance perspective view illustrating the front surface 42-side of the cartridge 4K. FIG. 10 is a front view illustrating the cartridge 4K. FIG. 11 is a partial sectional view illustrating the cartridge 4K taken along a line F11-F11 in FIG. 10.

The cartridge 4K includes a first positioning portion (first cartridge-side positioning portion) 422, a second positioning portion (second cartridge-side positioning portion) 424 and a fixation structure (cartridge-side fixation structure) 49. The first positioning portion 422 and the second positioning portion 242 are provided on the front surface 42.

The first positioning portion 422 is a portion to be engaged with the first apparatus-side positioning portion 82 (shown in FIG. 3). The first positioning portion 422 is a through hole formed in the front surface 42. In the process of mounting the cartridge 4K to the cartridge mounting assembly 6 (mounting process), inserting the first apparatus-side positioning portion 82 of the rod-like shape into the first positioning portion 422 of the through hole shape causes these positioning portions 422 and 82 to be engaged with each other.

The second positioning portion 424 is a portion to be engaged with the second apparatus-side positioning portion 84 (shown in FIG. 3). The second positioning portion 424 is a through hole formed in the front surface 42. In the mounting state of the cartridge 4K, the second positioning portion 424 is located vertically below the first positioning portion 422. In the mounting state, the first positioning portion 422 and the second positioning portion 424 are arranged away from each other along the Z-axis direction. In the mounting process, inserting the second apparatus-side positioning portion 84 of the rod-like shape into the second positioning portion 424 of the through hole shape causes these positioning portions 424 and 84 to be engaged with each other.

The following further describes the positioning functions of the first and the second apparatus-side positioning portions 82 and 84 and the first and the second positioning portions 422 and 424.

In the process of mounting the cartridge 4K, the leading end portions (+Y-axis direction end portions) of the first and the second apparatus-side positioning portions 82 and 84 are inserted into the corresponding first and second positioning portions 422 and 424 (start of positioning engagement). The cartridge 4K is then pressed toward the mounting direction (−Y-axis direction). The first and the second apparatus-side positioning portions 82 and 84 serve to restrict the move of the cartridge 4K in the direction crossing the mounting direction (direction along the front surface 42). Accordingly the cartridge 4K is moved in the mounting direction on the basis of the first and the second apparatus-side positioning portions 82 and 84.

As shown in FIG. 10, the first positioning portion 422 is a circular hole, and the second positioning portion 424 is a long hole elongated in the Z-axis direction. The first positioning portion 422 has a circular shape in a section perpendicular to the center axis CL direction of the liquid outflow portion 414 (mounting direction of the cartridge 4K). In the section perpendicular to the center axis CL direction, the first positioning portion 422 and the first apparatus-side positioning portion 82 have substantially corresponding outer shapes.

The second positioning portion 424 has an elliptical shape elongated in the Z-axis direction in the section perpendicular to the center axis CL direction of the liquid outflow portion 414 (mounting direction of the cartridge 4K).

Forming the second positioning portion 424 as the long hole facilitates allowance of dimensional tolerance or the like, while maintaining the positioning accuracy. More specifically, the outer shape of the second positioning portion 424 is formed slightly larger than the outer shape of the second apparatus-side positioning portion 84 in the section perpendicular to the center axis CL direction (mounting direction of the cartridge 4K). In the state that the second apparatus-side positioning portion 84 is inserted into the second positioning portion 424, a little clearance is accordingly provided between an inner circumferential surface of the second positioning portion 424 and an outer circumferential surface of the second apparatus-side positioning portion 84. In the mounting process, the positioning accuracy of the cartridge 4K is ensured by the first positioning portion 422, and a relative positional misalignment between the second positioning portion 424 and the second apparatus-side positioning portion 84 due to the dimensional tolerance or the like is absorbed by the second positioning portion 424.

The fixation structure 49 (shown in FIG. 9) is a portion to be engaged with the apparatus-side fixation structure 75. The fixation structure 49 is a groove (fixation groove) formed in the second side surface 44. In the course of mounting or demounting the cartridge 4K to or from the cartridge mounting assembly 6, the locking pin 737 (shown in FIG. 3) moves in the fixation structure 49 of the groove shape. In the mounting state of the cartridge 4K, the locking pin 737 engages with the fixation structure 49 of the groove shape. Pressing the cartridge 4K toward the −Y-axis direction in the mounting state of the cartridge 4K releases the engagement of the locking pin 737 with the fixation structure 49 and enables the cartridge 4K to be demounted from the cartridge mounting assembly 6.

The cartridge 4K (shown in FIG. 7) further includes a recess 90, a liquid-outflow fluid receiving portion 957, a first stirring fluid receiving portion 958, a second stirring fluid receiving portion 959, a circuit board 50 and a flow port placing hole 445. Part of the second surface 41 connecting with the first side surface 43 is called second upper surface 41A, and part of the second surface 41 connecting with the second side surface 44 is called second lower surface 41B. The second lower surface 41B forms a bottom surface of the recess 90 as described above. Accordingly the second lower surface 41B is also called recess bottom surface 99.

The circuit board 50 is placed on a terminal placement portion 80 that is a surface connecting the front surface 42 with the second upper surface 41A. The terminal placement portion 80 includes an inclined surface (inclined wall) 484 that is inclined relative to the mounting direction (−Y-axis direction), and a connecting surface (connecting wall) 482 that is arranged to connect the inclined surface 484 with the second upper surface 41A. The inclined surface 484 is inclined to face in a direction including a +Z-axis direction component and a −Y-axis direction component. The connecting surface 482 is a horizontal surface in the mounting state. The circuit board 50 is placed on the inclined surface 484. The circuit board 50 is located vertically above the first positioning portion 422. Cartridge-side terminals 52 are arranged on a surface 50*fa* of the circuit board 50 to come in contact with the apparatus-side terminals 692 of the apparatus-side terminal assembly 69 (shown in FIG. 3). A plurality of (nine in this embodiment) cartridge-side terminals 52 are provided corresponding to the plurality of apparatus-side terminals 692. In the mounting process, bringing the apparatus-side terminals 692 in contact with the cartridge-side terminals 52 starts after the start of positioning engagement described later.

A storage device is provided on a rear face of the circuit board 50. The storage device stores, for example, information regarding the ink of the cartridge 4K (for example, the remaining amount of ink and the color of ink contained therein). Bringing the cartridge-side terminals 52 into contact with the apparatus-side terminals 692 of the printing apparatus 20 allows for transmission of for example, data signals between the storage device and the controller 230 of the printing apparatus 20.

The flow port placing hole 445 is formed in the front surface 42. More specifically, in the mounting state of the cartridge 4K, the flow port placing hole 445 is located between the first positioning portion 422 and the second positioning portion 424 in the vertical direction. The flow port placing hole 445 receives the liquid outflow portion 414. At least an opening at one end (leading end) of the liquid outflow portion 414 is placed in the flow port placing hole 445.

The recess 90 is formed in the front surface 42. In the mounting state of the cartridge 4K, the recess 90 is located between the first positioning portion 422 and the second positioning portion 424. The recess 90 is open toward the mounting direction (−Y-axis direction). The recess 90 includes the recess bottom surface 99 (shown in FIG. 7), an opening 91 (shown in FIG. 7), a first recess side surface 93 (shown in FIG. 9), a second recess side surface 94 (shown in FIG. 7), a third recess side surface 95 (shown in FIG. 8) and a fourth recess side surface 96 (shown in FIG. 7). The respective components 99, 91, 93, 94, 95 and 96 define and form the recess 90.

The recess bottom surface 99 and the opening 91 are opposed to each other in the Y-axis direction (as shown in FIG. 7). The recess bottom surface 99 is located on the +Y-axis direction (demounting direction) side, and the opening 91 is located on the −Y-axis direction (mounting direction) side. The first recess side surface 93 and the second recess side surface 94 are opposed to each other in the Z-axis direction (as shown in FIG. 10). The first recess side surface 93 is located on the +Z-axis direction (vertically upper) side, and the second recess side surface 94 is located on the -Z-axis direction (vertically lower) side. The third recess side surface 95 and the fourth recess side surface 96 are opposed to each other in the X-axis direction (width direction of the cartridge 4K) (as shown in FIG. 10). The third recess side surface 95 is located on the +X-axis direction side, and the fourth recess side surface 96 is located on the −X-axis direction side.

The recess bottom surface 99 is formed in an approximately rectangular outer shape. The opening 91 is placed on the front surface 42. In the mounting process, the liquid supply pressurizing portion 67, the first stirring pressurizing portion 70 and the second stirring pressurizing portion (shown in FIG. 3) as parts of the pressurizing mechanism 280 pass through this opening 91. The first recess side surface 93, the second recess side surface 94, the third recess side surface 95, and the fourth recess side surface 96 are erected in the mounting direction from the respective sides forming the outer shape (peripheral edge) of the recess bottom surface 99.

The recess 90 is formed by the first casing 5 and the second casing 7. More specifically, the recess bottom surface 99, the fourth recess side surface 96 and the first recess side surface 93 are formed by the first casing 5 (as shown in FIGS. 9 and 10). The second recess side surface 94 and the opening 91 are formed by the first casing 5 and the second casing 7 (as shown in FIG. 10). The third recess side surface 95 is formed by the second casing 7 (as shown in FIG. 8).

As shown in FIG. 10, the liquid-outflow fluid receiving portion 957, the first stirring fluid receiving portion 958 and the second stirring fluid receiving portion 959 are placed inside of the recess 90.

The liquid-outflow fluid receiving portion 957 is a tubular member (shown in FIG. 7). The liquid-outflow fluid receiving portion 957 has a center axis C1 that is parallel to the center axis CL. The liquid-outflow fluid receiving portion 957 is protruded toward the mounting direction from the recess bottom surface 99. Abase end portion (+Y-axis direction side portion) of the liquid-outflow fluid receiving portion 957 is connected with the recess bottom surface 99. The flow path formed inside of the liquid-outflow fluid receiving portion 957 is arranged to communicate the outside of the cartridge 4K with the inner chamber 440 (shown in FIG. 5). In the mounting state, a leading end portion (−Y-axis direction side portion) 957F of the liquid-outflow fluid receiving portion 957 is inserted into the liquid supply pressurizing portion 67 to be connected with the liquid supply pressurizing portion 67. More specifically, the leading end portion 957F is inserted into the inside of the tubular seal member of the liquid supply pressurizing portion 67, so as to be air-tightly connected with the liquid supply pressurizing portion 67. The leading end portion 957F receives the pressurized fluid supplied through the liquid supply pressurizing portion 67. In other words, the pressurized fluid supplied from the printer 20 reaches the leading end portion 957F. The leading end portion 957F has an opening. The pressurized fluid passes through this opening and flows through the inner flow path of the liquid-outflow fluid receiving portion 957 into the inner chamber 440.

The first stirring fluid receiving portion 958 is a tubular member. The first stirring fluid receiving portion 958 has a center axis C2 that is parallel to the center axis CL. The firs stirring fluid receiving portion 958 is protruded toward the mounting direction from the recess bottom surface 99. Abase end portion (+Y-axis direction side portion) of the first stirring fluid receiving portion 958 is connected with the recess bottom surface 99. The flow path formed inside of the first stirring fluid receiving portion 958 is arranged to communicate outside of the cartridge 4K with the first fluid flow portion 406. In the mounting state, a leading end portion (−Y-axis direction side portion) 958F of the first stirring fluid receiving portion 958 is inserted into the first stirring pressurizing portion 70 (shown in FIG. 3) to be connected with the first stirring pressurizing portion 70. More specifically, the leading end portion 958F is inserted into the inside of the tubular seal member of the first stirring pressurizing portion 70, so as to be air-tightly connected with the first stirring pressurizing portion 70. The leading end portion 958F receives the pressurized fluid supplied through the first stirring pressurizing portion 70. In other words, the pressurized fluid supplied from the printer 20 reaches the leading end portion 958F. The leading end portion 958F has an opening. The pressurized fluid passes through this opening and flows through the inner flow path of the first stirring pressurizing portion 70 to the first fluid flow portion 406. The pressurized fluid is introduced through the first fluid flow portion 406 into the first stirring portion 403.

The second stirring fluid receiving portion 959 is a tubular member. The second stirring fluid receiving portion 959 has a center axis C3 that is parallel to the center axis CL. The second stirring fluid receiving portion 959 is protruded toward the mounting direction from the recess bottom surface 99. Abase end portion (+Y-axis direction side portion) of the second stirring fluid receiving portion 959 is connected with the recess bottom surface 99. The flow path formed inside of the second stirring fluid receiving portion 959 is arranged to communicate outside of the cartridge 4K with the second fluid flow portion 408. In the mounting state, a leading end portion (−Y-axis direction side portion) 959F of the second stirring fluid receiving portion 959 is inserted into the second stirring pressurizing portion 72 (shown in FIG. 3) to be connected with the second stirring pressurizing portion 72. More specifically, the leading end portion 959F is inserted into the inside of the tubular seal member of the second stirring pressurizing portion 72, so as to be air-tightly connected with the second stirring pressurizing portion 72. The leading end portion 959F receives the pressurized fluid supplied through the second stirring pressurizing portion 72. In other words, the pressurized fluid supplied from the printer 20 reaches the leading end portion 959F. The leading end portion 959F has an opening. The pressurized fluid passes through this opening and flows through the inner flow path of the second stirring pressurizing portion 72 to the second fluid flow portion 408. The pressurized fluid is introduced through the second fluid flow portion 408 into the second stirring portion 407.

As described above, the respective peripheries of the liquid-outflow fluid receiving portion 957, the first stirring fluid receiving portion 958 and the second stirring fluid receiving portion 959 about the respective center axes C1, C2 and C3 are surrounded by the walls (recess side surfaces) 93, 94, 95 and 96 that form the recess 90. The recess 90 is open only in the mounting direction.

As shown in FIG. 10, the first stirring fluid receiving portion 958 and the second stirring fluid receiving portion 959 are arranged opposite to the liquid-outflow fluid receiving portion 957 across a virtual plane PL1. The virtual plane PL1 is a plane that passes through the center axis CL of the liquid outflow portion 414 and is parallel to the vertical direction in the mounting state. The virtual plane PL1 passes through the center in the width of the cartridge 4K.

At least one of the liquid-outflow fluid receiving portion 957, the first stirring fluid receiving portion 958 and the second stirring fluid receiving portion 959 corresponds to the "fluid receiving portion" described in Summary. The liquid-outflow fluid receiving portion 957 corresponds to the "first fluid receiving portion" described in Summary. At least either one of the first stirring fluid receiving portion 958 and the second stirring fluid receiving portion 959 corresponds to the "second fluid receiving portion" described in Summary.

A-4. Configurations of Cartridges 4C, 4M and 4Y

The configurations of the cartridges 4C, 4M and 4Y differ from the configuration of the cartridge 4K by that the first and second stirring fluid receiving portions 958 and 959 (shown in FIG. 7) and the first and second stirring members 402 and 404 (shown in FIG. 5) are omitted and that the less amount of ink is contained in the liquid container 412. The other configurations of the cartridges 4C, 4M and 4Y are similar to that of the cartridge 4K. The cartridges 4C, 4M and 4Y have a recess 90 in a front surface 42. The recess 90 is open toward the mounting direction. A liquid-outflow fluid receiving portion 957 is placed inside of the recess 90.

A-5. Advantageous Effects

According to the embodiment described above, the fluid receiving portions 957, 958 and 959 are provided in the recess 90 that is open toward the mounting direction (−Y-axis direction) (as shown in FIG. 7). According to this embodiment, the recess 90 is open only in the mounting direction. The respective peripheries of the fluid receiving portions 957, 958 and 959 about the respective center axes C1, C2 and C3 are surrounded by the walls 93, 94, 95 and 96 that form the recess 90. This configuration reduces the likelihood that the human hand directly touches the fluid receiving portions 957, 958 and 959 during assembly of the cartridge 4K or during handling of the cartridge 4K by the user. This configuration also reduces the likelihood that fluid receiving portions 957, 958 and 959 collide with any member other than the cartridge 4K, for example, the mounting surface. In other words, this configuration reduces the likelihood that an external force is directly applied to the fluid receiving portions 957, 958 and 959. This accordingly reduces the likelihood that the fluid receiving portions 957, 958 and 959 are deformed and the likelihood that any foreign substance adheres to the fluid receiving portions 957, 958 and 959. This also reduces the likelihood that ink leaking from the liquid supply portion 643 or the liquid outflow portion 414 during mounting or demounting operation of the cartridge 4K adheres to the fluid receiving portions 957, 958 and 959 or their peripheries. The configuration reduces the occurrence of troubles with regard to the fluid receiving portions 957, 958 and 959 and thereby reduces the occurrence of poor connection between the fluid receiving portions 957, 958 and 959 and the corresponding portions 67, 70 and 72 of the cartridge mounting assembly 6 (shown in FIG. 3) (for example, a problem that the sealing properties in connection are not sufficiently maintained). According to the embodiment described above, the fluid receiving portions 957, 958 and 959 are located between the first positioning portion 422 and the second positioning portion 424. This configuration suppresses positional misalignment of the fluid receiving portions 957, 958 and 959 relative to the cartridge mounting assembly 6.

According to the embodiment described above, the cartridge 4K includes the plurality of fluid receiving portions 957, 958 and 959 (as shown in FIG. 7). When the plurality of fluid receiving portions 957, 958 and 959 are to be arranged, there is generally a need for a wide space for the arrangement. The wider space for the arrangement increases the likelihood that the user or the like touches the fluid receiving portions 957, 958 and 959 in the arrangement space or that ink or another foreign substance adheres to the fluid receiving portions 957, 958 and 959. According to the embodiment described above, however, the plurality of fluid receiving portions 957, 958 and 959 are provided in the recess 90 that is open toward the mounting direction (−Y-axis direction). This configuration reduces this likelihood.

According to the embodiment described above, the liquid-outflow fluid receiving portion 957 as the first fluid receiving portion is arranged opposite to the first and the second stirring fluid receiving portions 958 and 959 as the second fluid receiving portions across the virtual plane PL1 that passes through the center axis CL of the liquid outflow portion 414 and is parallel to the vertical direction (as shown in FIG. 10). This configuration reduces the likelihood that the cartridge 4K is inclined about the liquid outflow portion 414 in the X-axis direction (width direction of the cartridge 4K).

According to this embodiment, the seal members are placed in the corresponding portions 67, 70 and 72 of the cartridge mounting assembly 6 which the fluid receiving portions 957, 958 and 959 are connected with. In the mounting state, the fluid receiving portions 957, 958 and 959 receive the elastic force from the sealing members, so that the cartridge 4K is likely to be inclined about the first positioning portion 422 or the liquid outflow portion 414. According to the embodiment described above, however, the first fluid receiving portion 957 is arranged opposite to the second fluid receiving portions 958 and 959 across the virtual plane PL1. Compared with a configuration that all the plurality of fluid receiving portions 957, 958 and 959 are arranged in one single side relative to the virtual plane PL, this configuration locates the plurality of fluid receiving portions 957, 958 and 959 with the better balance relative to the cartridge 4K. This configuration accordingly suppresses the cartridge 4K from being inclined. Suppressing inclination of the cartridge 4K ensures the good sealing properties in connection between the fluid receiving portions 957, 958 and 959 and the corresponding portions 67, 70 and 72 of the cartridge mounting assembly 6.

According to the embodiment described above, the cartridge 4K includes the inner chamber 440 that is configured to pressurize the liquid container 412 by means of the pressurized fluid and supply the ink contained in the liquid container 412 to the record head 225, and the stirring portions 403 and 407 that are configured to stir the ink contained in the liquid container 412 by means of the pressurized fluid (as shown in FIG. 5). This configuration uses the pressurized fluid to supply the ink contained in the liquid container 412 to the record head 225 and stir the ink contained in the liquid container 412. According to this embodiment, the pressurized fluid for stirring ink and the pressurized fluid for supplying ink to the record head 225 are supplied to the cartridge 4K by using the common pressurizing pump 226 (as shown in FIG. 1). This simplifies the configuration of the printer 20.

B. Second Embodiment

Figure 12:
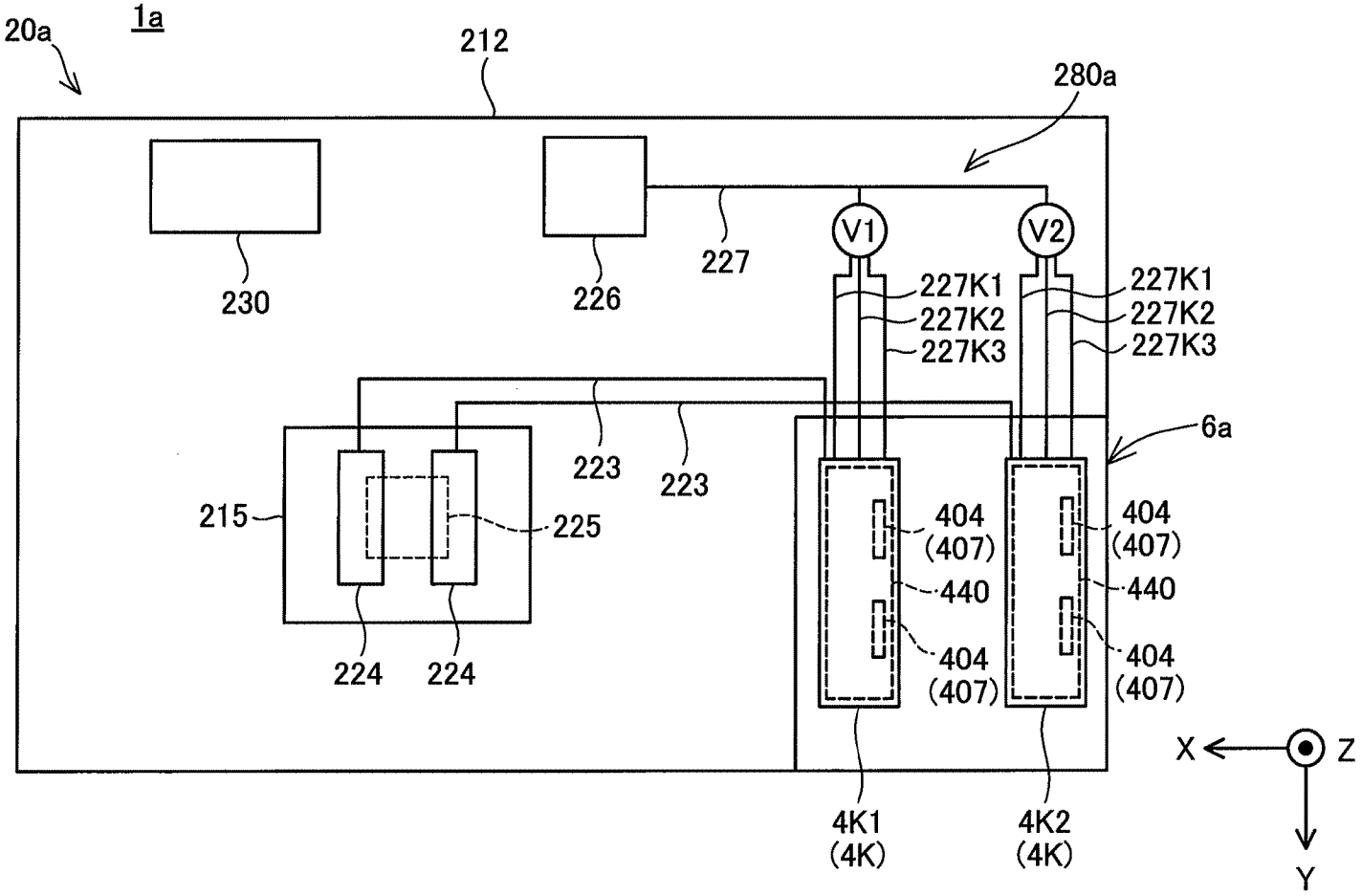
FIG. 12 is a diagram illustrating a liquid ejection system according to a second embodiment.

FIG. 12 is a diagram illustrating a liquid ejection system la according to a second embodiment of the invention. The differences from the liquid ejection system 1 of the first embodiment (shown in FIG. 1) include that two cartridge 4K containing black ink are mountable to a cartridge mounting assembly 6*a* and that a pressurizing mechanism 280*a* has a different configuration. The other configuration of the liquid ejection system la of the second embodiment is similar to that of the liquid ejection system 1 of the first embodiment. The like components are expressed by the like symbols and are not specifically described. The components that are not involved in the description (for example, guide shaft 214 shown in FIG. 1) are omitted from the illustration as appropriate.

The cartridge mounting assembly 6*a* is configured to enable two cartridges 4K to be mounted. Accordingly, two slots 61K (shown in FIG. 3) are provided, and the members for connecting the cartridge 4K (for example, liquid supply pressurizing portion 67, first stirring pressurizing portion 70, second stirring pressurizing portion 72 and liquid supply portion 643) are provided corresponding to each of the cartridge 4K. A printer 20*a* has a fluid flow passage 227 connecting with a pressurizing pump 226. The fluid flow passage 227 is branched into two branched flow passages which are respectively provided with valves V1 and V2. A first fluid flow passage 227K1, a second fluid flow passage 227K2 and a third fluid flow passage 227K3 are provided in the downstream of each of the valves V1 and V2. The first fluid flow passage 227K1 is arranged to flow the pressurized air for supplying ink contained in the cartridge 4K to the record head 225, to the cartridge 4K (or more specifically to a pressurizing chamber 440). The second and the third fluid flow passages 227K2 and 227K3 are arranged to flow the pressurized air to the stirring members 402 and 403 (shown in FIG. 5).

The controller 230 controls the pressurizing mechanism 280*a* as described below. When the pressurized air is supplied through the first fluid flow passage 227K1 to the pressurizing chamber 440 of a first cartridge 4K1, the pressurized air is not supplied to the pressurizing chamber 440 of a second cartridge 4K2. In other words, when the pressurizing chamber 440 of the first cartridge 4K1 receives the supply of the pressurized air, the pressurizing chamber 440 of the second cartridge 4K2 does not receive the supply of the pressurized air. With regard to each of the first and the second cartridges 4K1 and 4K2, when the pressurized air is not supplied to the pressurizing chamber 440, the pressurized air is supplied through the second fluid flow passage 227K2 and the third fluid flow passage 227K3 to the stirring portions 403 and 407. In other words, with regard to each of the first and the second cartridges 4K1 and 4K2, when the pressurizing chamber 440 does not receive the supply of the pressurized air, the stirring portions 403 and 407 receive the supply of the pressurized air.

According to the second embodiment, when the pressurizing chamber 440 does not receive the supply of the pressurized fluid, the ink contained in the liquid container 412 is stirred by the stirring portions 403 and 407. This configuration enables the ink contained in the liquid container 412 to be efficiently stirred by the stirring portions 403 and 407. The second embodiment has the similar configuration to that of the first embodiment and accordingly has the similar advantageous effects. For example, the fluid receiving portions 957, 958 and 959 are provided in the recess 90 that is open toward the mounting direction (−Y-axis direction) (as shown in FIG. 7). This configuration reduces the likelihood that the human hand directly touches the fluid receiving portions 957, 958 and 959 during assembly of the cartridge 4K or during handling of the cartridge 4K by the user. The first cartridge 4K1 and the second cartridge 4K2 correspond to the "cartridge unit" described in Summary.

C. Modifications

The invention is not limited to any of the embodiments and the examples described above but may be implemented by a diversity of other aspects without departing from the scope of the invention. Some of possible modifications are given below.

C-1. First Modification

Figure 13:
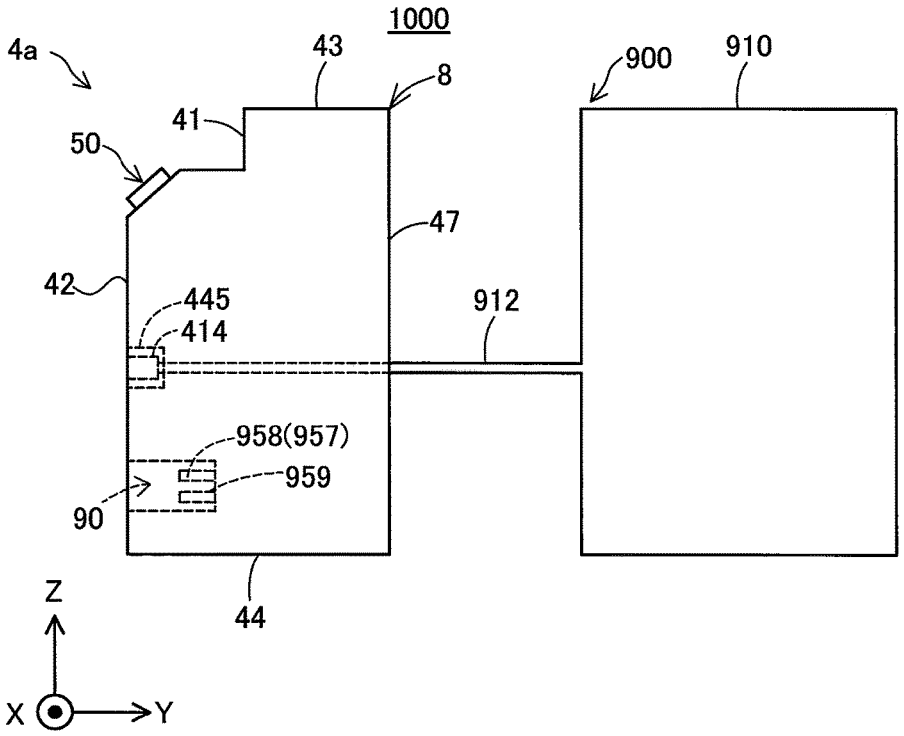
FIG. 13 is a diagram illustrating a cartridge according to a first modification.

According to the above embodiment, the cartridge 4 has the liquid container assembly 410 as the liquid supply source of the liquid that is to be supplied to the printer 20 (as shown in FIG. 5). This configuration is, however, not restrictive and the liquid container assembly 410 may be omitted. FIG. 13 is a diagram illustrating a cartridge 4*a* according to a first modification. The cartridge 4*a* is one component of a liquid supply apparatus 1000. The liquid supply apparatus 1000 includes the cartridge 4*a* and a liquid supply unit 900. The liquid supply unit 900 includes a tank 910 as a liquid supply source placed outside of the cartridge 4*a*, a liquid outflow portion 414 placed in a flow port placing hole 445 and a connecting member (tube) 912 that is arranged to communicate the tank 910 with the liquid outflow portion 414. The liquid outflow portion 414 may be regarded as a component of the cartridge 4*a*. Ink contained in the tank 910 is supplied toward the liquid outflow portion 414 by a pump (not shown) provided in the liquid supply unit 900.

The cartridge 4*a* has the appearance with omission of the +Y-axis direction portion from the cartridge 4K shown in FIG. 4. More specifically, the cartridge 4*a* has an open rear surface 47. None of the sheet member 430, the liquid container 412, the first stirring member 402 and the second stirring member 404 (shown in FIG. 8) is placed in the cartridge 4*a*. The cartridge 4*a* has a recess 90 similar to that of the cartridge 4K and has a liquid-outflow fluid receiving portion 957, a first stirring fluid receiving portion 958 and a second stirring fluid receiving portion 959 placed inside of the recess 90. The cartridge 4*a* may include or may not include the liquid-outflow fluid receiving portion 957, the first stirring fluid receiving portion 958 and the second stirring fluid receiving portion 959. The liquid-outflow fluid receiving portion 957, the first stirring fluid receiving portion 958 and the second stirring fluid receiving portion 959 may not have the original functions of flowing the pressurized fluid in the casing 8.

The embodiment has similar advantageous effects to those of the above embodiment, in terms of the similar configuration. For example, the fluid receiving portions 957, 958 and 959 are provided in the recess 90 that is open toward the mounting direction (−Y-axis direction). This configuration reduces the likelihood that the human hand directly touches the fluid receiving portions 957, 958 and 959 during assembly of the cartridge 4*a* or during handling of the cartridge 4*a* by the user.

C-2. Second Modification

The liquid container 412 is made of the material having flexibility in the embodiments and the modifications described above, but may at least partly made of a material having flexibility.

C-3. Third Modification

The recess 90 has the recess bottom surface 99 in the approximately rectangular shape (shown in FIG. 10) in the embodiments and the modifications described above. The recess 90 is, however, not limited to this configuration but may have any configuration that is open only in the mounting direction. For example, the recess 90 may be formed in such a configuration that has a circular recess bottom surface 99.

C-4. Fourth Modification

The pressurized fluid is the pressurized air in the embodiments and the modifications described above. The pressurized fluid may be another gas or a liquid such as water.

C-5. Fifth Modification

The cartridge 4 or 4*a* has the circuit board 50 in the embodiments and the modifications described above, but the circuit board 50 may be omitted.

C-6. Sixth Modification

The cartridge 4K has the components 958 (shown in FIG. 7), 959 (shown in FIG. 7), 402 (shown in FIGS. 5) and 404 (shown in FIG. 5) for stirring the liquid container 412 in the embodiments and the modifications described above, but these components may be omitted. Any of the cartridges 4C, 4M and 4Y may additionally include the components 958 (shown in FIG. 7), 959 (shown in FIG. 7), 402 (shown in FIGS. 5) and 404 (shown in FIG. 5) for stirring the liquid container 412.

C-7. Seventh Modification

In the embodiments and the modifications described above, the cartridge 4 or 4*a* is used to supply ink to the printer 20. The invention is, however, applicable to a liquid ejection apparatus that is configured to eject another liquid. Some examples of the liquid ejection apparatus are given below:

(1) image recording apparatus, such as a facsimile machine;

(2) color material ejection apparatus used to manufacture color filters for an image display apparatus, e.g., a liquid crystal display;

(3) electrode material ejection apparatus used to form electrodes of, for example, an organic EL (electroluminescence) display and a field emission display (FED);

(4) liquid ejection apparatus configured to eject a bioorganic material-containing liquid used for manufacturing biochips;

(5) sample ejection apparatus used as a precision pipette;

(6) ejection apparatus of lubricating oil;

(7) ejection apparatus of a resin solution;

(8) liquid ejection apparatus for pinpoint ejection of lubricating oil on precision machines such as watches or cameras;

(9) liquid ejection apparatus configured to eject a transparent resin solution, such as an ultraviolet curable resin solution, onto a substrate in order to manufacture a hemispherical microlens (optical lens) used for, for example, optical communication elements;

(10) liquid ejection apparatus configured to eject an acidic or alkaline etching solution in order to etch a substrate or the like; and

(11) liquid ejection apparatus equipped with a liquid consuming head for ejecting a very small volume of droplets of any other liquid.

The "droplet" herein means the state of liquid ejected from the liquid ejection recording apparatus or the liquid ejection apparatus and may be in a granular shape, a teardrop shape or a tapered threadlike shape. The "liquid" herein may be any material ejectable by the liquid consuming recording apparatus or the liquid ejection apparatus (liquid consuming apparatus). The "liquid" may be any material in the liquid phase. For example, liquid-state materials of high viscosity or low viscosity, sols, aqueous gels and other liquid-state materials including inorganic solvents, organic solvents, solutions, liquid resins and liquid metals (metal melts) are included in the "liquid". The "liquid" is not limited to the liquid state as one of the three states of matter but includes solutions, dispersions and mixtures of the functional solid material particles, such as pigment particles or metal particles, solved in, dispersed in or mixed with a solvent. Typical examples of the liquid include ink described in the above embodiment and liquid crystal. The ink herein includes general water-based inks and oil-based inks, as well as various liquid compositions, such as gel inks and hot-melt inks. In an application using a liquid container configured to contain UV ink curable by UV radiation and connected with the printer, the arrangement of the liquid container coming off the placement surface reduces the likelihood that the UV ink is cured by transmission of heat from the placement surface to the liquid container.

C-8. Eighth Modification

The invention is not limited to any of the embodiments and the modifications described above but may be implemented by a diversity of other configurations without departing from the scope of the invention. For example, the technical features of any of the embodiments and modifications corresponding to the technical features of each of the aspects described in Summary may be replaced or combined appropriately, in order to solve part or all of the problems described above or in order to achieve part or all of the advantageous effects described above. Any of the technical features may be omitted appropriately unless the technical feature is described as essential herein.

What is claimed is:

1. A cartridge that is mountable to a liquid ejection apparatus, wherein the liquid ejection apparatus comprises a pressurizing mechanism configured to supply a pressurized fluid and a liquid ejection assembly configured to eject a liquid, the cartridge comprising:

a liquid container that is at least partly made of a flexible material and is configured to contain the liquid therein;

a recess that is configured to be open toward a mounting direction of the cartridge to the liquid ejection apparatus;

a fluid receiving portion that is disposed inside of the recess and is configured to receive a supply of the pressurized fluid, and a terminal arranged outside of the recess and on an inclined surface, the inclined surface being connected to a front surface and being inclined relative to the mounting direction.

2. The cartridge according the claim 1, further comprising:

a first positioning portion configured to be engaged with a second apparatus-side positioning portion, and a second positioning portion configured to be engaged with a second apparatus-side positioning portion, wherein the fluid receiving portion is located between the first positioning portion and the second positioning portion.

3. The cartridge according to claim 1, the cartridge comprising a plurality of the fluid receiving portions.

4. The cartridge according to claim 3, further comprising a liquid outflow portion that is configured to flow out the liquid contained in the liquid container toward the liquid ejection apparatus, the liquid outflow portion being arranged to have a center axis that is extended in a predetermined direction, wherein the plurality of fluid receiving portions include a first fluid receiving portion and a second fluid receiving portion, wherein the first fluid receiving portion and the second fluid receiving portion are arranged across a virtual plane that passes through the center axis and is parallel to a vertical direction in a mounting state of the cartridge that the cartridge is mounted to the liquid ejection apparatus.

5. The cartridge according to claim 3, further comprising:

a pressurizing chamber that is arranged to receive the supply of the pressurized fluid from the liquid ejection apparatus by at least one of the plurality of fluid receiving portions and is configured to press the liquid container to the liquid ejection apparatus; and a stirring portion that is arranged to receive the supply of the pressurized fluid from the liquid ejection apparatus by at least a different one of the plurality of fluid receiving portions and is configured to press the liquid container and stir the liquid contained in the liquid container.

6. A cartridge unit, comprising:

a cartridge according to claim 5 as a first cartridge; and another cartridge according to claim 5 as a second cartridge, wherein the cartridge unit is configured such that:

when the pressurizing chamber of the first cartridge receives the supply of the pressurized fluid, the pressurizing chamber of the second cartridge does not receive the supply of the pressurized fluid, and in each of the first and second cartridges, the stirring portion receives the supply of the pressurized fluid when the pressurizing chamber does not receive the supply of the pressurized fluid.

7. a liquid ejection system, comprising:

a liquid ejection apparatus; and the cartridge according to claim 1.

8. A cartridge that is mountable to a liquid ejection apparatus, wherein the liquid ejection apparatus comprises a pressurizing mechanism configured to supply a pressurized fluid and a liquid ejection assembly configured to eject a liquid, the cartridge comprising:

a liquid container that is at least partly made of a flexible material and is configured to contain the liquid therein;

a recess that is configured to be open toward a mounting direction of the cartridge to the liquid ejection apparatus;

a plurality of the fluid receiving portions including a first fluid receiving portion that is placed inside of the recess and is configured to receive a supply of the pressurized fluid;

a pressurizing chamber that is arranged to receive the supply of the pressurized fluid from the liquid ejection apparatus by a second fluid receiving portion of the plurality of fluid receiving portions and is configured to press the liquid contained in the liquid container to the liquid ejection apparatus; and a stirring portion that is arranged to receive the supply of the pressurized fluid from the liquid ejection apparatus by at least a third fluid receiving portion of the plurality of fluid receiving portions different from the first fluid receiving portion and the second fluid receiving portion, the stirring portion configured to press the liquid container and stir the liquid contained in the liquid container.

9. A cartridge unit, comprising:

a cartridge according to claim 8 as a first cartridge; and another cartridge according to claim 8 as a second cartridge, wherein the cartridge unit is configured such that:

when the pressurizing chamber of the first cartridge receives the supply of the pressurized fluid, the pressurizing chamber of the second cartridge does not receive the supply of the pressurized fluid, and in each of the first and the second cartridges, the stirring portion receives the supply of the pressurized fluid when the pressurizing chamber does not receive the supply of the pressurized fluid.

10. A cartridge that is mountable to a liquid ejection apparatus, wherein the liquid ejection apparatus comprises a pressurizing mechanism configured to supply a pressurized fluid and a liquid ejection assembly configured to eject a liquid, the cartridge comprising:

a liquid container that is at least partly made of a flexible material and is configured to contain the liquid therein;

a recess disposed in a mounting direction side surface of the cartridge, the recess configured to be open toward a mounting direction of the cartridge to the liquid ejection apparatus;

a fluid receiving portion that is disposed inside of the recess and is configured to receive a supply of the pressurized fluid, a terminal arranged on an inclined surface, the inclined surface being connected to a front surface and being inclined relative to the mounting direction;

a first positioning portion configured to be engaged with a second apparatus-side positioning portion; and a second positioning portion configured to be engaged with a second apparatus side positioning portion, wherein the first positioning portion and the second positioning portion are disposed on the mounting direction side surface of the cartridge, and the fluid receiving portion is located between the first positioning portion and the second positioning portion.

11. A cartridge that is mountable to a liquid ejection apparatus, wherein the liquid ejection apparatus comprises a pressurizing mechanism configured to supply a pressurized fluid and a liquid ejection assembly configured to eject a liquid, the cartridge comprising:

a liquid container that is at least partly made of a flexible material and is configured to contain the liquid therein;

a recess that is configured to be open toward a mounting direction of the cartridge to the liquid ejection apparatus;

a plurality of fluid receiving portions that are each disposed inside of the recess and are each configured to receive a supply of the pressurized fluid from the liquid ejection apparatus and to pass through the pressurized fluid; and a terminal arranged on an inclined surface, the inclined surface being connected to a front surface and being inclined relative to the mounting direction.

* * * * *